United States Patent [19]

DuFort

[11] Patent Number: 4,849,763

[45] Date of Patent: Jul. 18, 1989

[54] LOW SIDELOBE PHASED ARRAY ANTENNA USING IDENTICAL SOLID STATE MODULES

[75] Inventor: Edward C. DuFort, Fullerton, Calif.

[73] Assignee: Hughes Aircraft Company, Los Angeles, Calif.

[21] Appl. No.: 41,811

[22] Filed: Apr. 23, 1987

[51] Int. Cl.[4] ..... H01Q 3/22; H01Q 3/24; H01Q 3/26

[52] U.S. Cl. ..... 342/372; 342/373

[58] Field of Search ..... 342/372, 373

[56] References Cited

U.S. PATENT DOCUMENTS

| | | | |
|---|---|---|---|
| 3,422,428 | 1/1969 | Marston | 343/854 |
| 3,750,175 | 7/1973 | Lockerd et al. | 343/100 |
| 4,045,800 | 8/1977 | Tang et al. . | |
| 4,122,453 | 10/1978 | Profera . | |
| 4,424,500 | 1/1984 | Viola et al. | 333/128 |
| 4,566,013 | 1/1986 | Steinberg et al. | 343/372 |

OTHER PUBLICATIONS

GEC Journal of Research, vol. 3, No. 4, 1985 (Chelmsford, Essex, GB), N. Easton et al.: "A Solid State Transmitter with Adaptive Beamforming", pp. 261–267.

IEEE Transactions on Antennas and Propagation, vol. AP-18, No. 6, Nov. 1970, H. E. Foster et al.: "Butler Network Extension to Any Number of Antenna Ports", pp. 818–820.

International Search Report for International Application No. PCT/U.S. 88/01242.

*Primary Examiner*—Theodore M. Blum

*Attorney, Agent, or Firm*—Thomas A. Runk; Anthony W. Karambelas

[57] ABSTRACT

An electrically scanned phased array with low sidelobes and tapered aperture illumination is disclosed. The array is fed by a uniform corporate feed network (55) and includes a main array aperture formed by main radiating elements (72–75) and first and second ancillary arrays formed by ancillary radiating elements (70–71) and (76–77). For a linear aperture, the outputs from the feed network (55) are phase shifted to steer the beam to one of the available beam locations, and coupled to corresponding ones of the main array radiating elements (72–75) and the ancillary array radiating elements (70–71or 76–77). The beam steering phase shifts invoke uniform phase gradients between the elements of the respective array, and bi-state phase correctors (85–88) are provided to correct for phase gradient discontinuities across the main and ancillary array apertures. The coupling values between the respective elements of the main array radiating elements (72–75) and the corresponding ancillary array radiating elements (70–71 and 76–77) are selected to provide a desired aperture illumination, such as a tapered aperture illumination. The array may be constructed with identical modules, resulting in improved performance at lower cost.

27 Claims, 17 Drawing Sheets

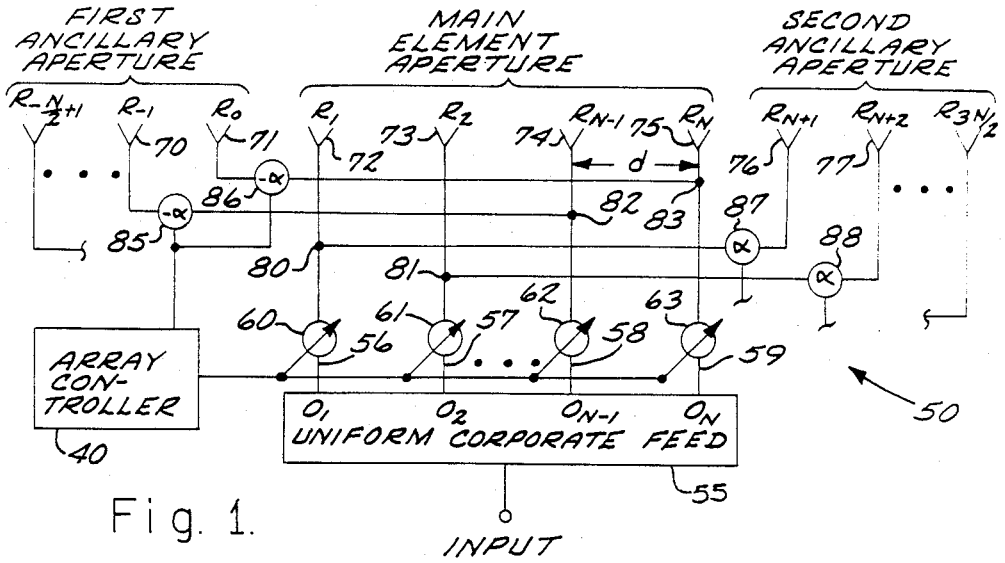
Fig. 1.
Fig. 4.
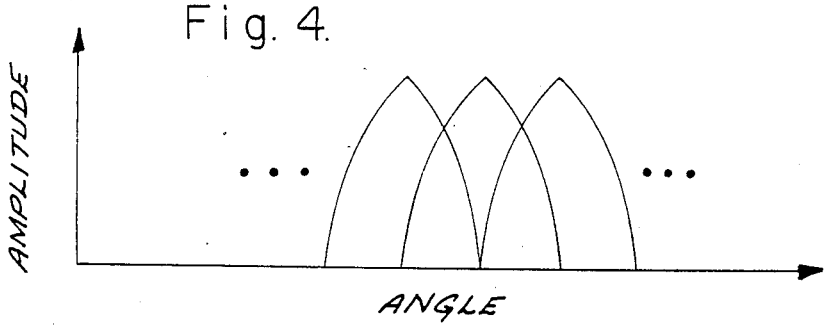
BEAMS FROM BASIC ARRAY
Fig. 5.
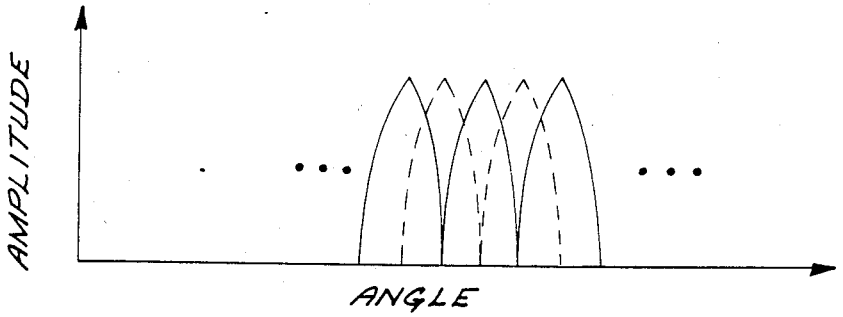
BEAMS FROM EXTENDED ARRAY $$A_{n,m+L} = \pm \sin\beta_2/\sqrt{2}$$
$$A_{n+N,m} = \pm \sin\beta_1/\sqrt{2}$$
$$A_{n,m} = \sqrt{\frac{\cos^2\beta_1 + \cos^2\beta_2}{2}}$$
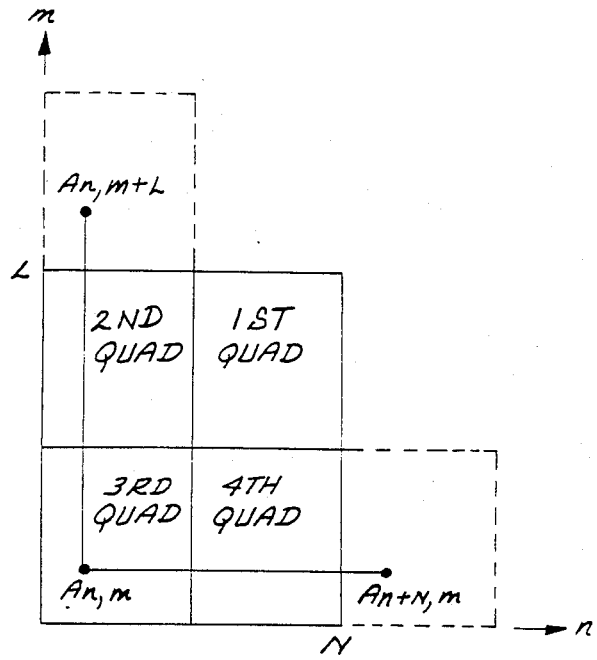
Fig. 13.
Fig. 14.
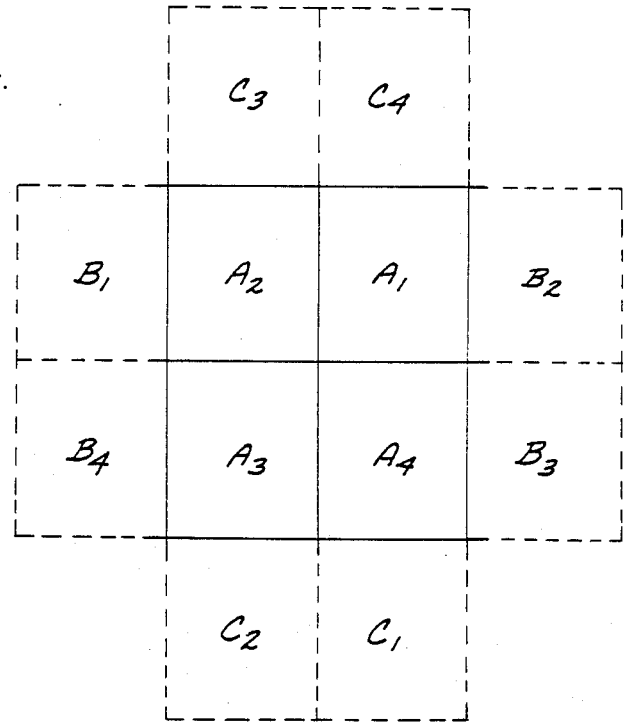

LOW SIDELOBE PHASED ARRAY ANTENNA USING IDENTICAL SOLID STATE MODULES

BACKGROUND OF THE INVENTION

The invention relates to phased array antennas employing active RF modules containing transmit and/or receive amplifiers, and more particularly to a technique for achieving low sidelobes in such an antenna.

Phased array antennas which employ feed networks and comprising active transmit/receive microwave modules have been implemented and described in the literature.

Techniques for controlling the sidelobes of such systems also exist. One technique which has been used in the past to achieve low transmit sidelobes (tapered aperture illumination) is to use modules with different power outputs. This provides a stepped aperture distribution which produces low sidelobes adjacent the beam. Disadvantages of this technique are:

1. The steps in the aperture distribution lead to high sidelobes in the region away from the beam.
2. The requirement of modules having different power outputs leads to higher production cost.
3. The different output powers of the modules are obtained by varying the number of solid state devices in the output stage. This requires different combiners with different losses and phase error, thus making the system more complex.
4. Different driver chains are required leading to phase and amplitude tracking (between modules) over the frequency band thus tending to increase the sidelobes.

To get a tapered amplitude, varying the modules, supply voltages will change output power; however, the dc-to-rf efficiency decreases and phase tracking is difficult, particularly in the class C amplifiers often used. The use of class A amplifiers will produce varying output by simply varying the input; however, the efficiency will be poor since typically a 10 dB output power variation is required.

Another technique which requires only identical modules is to decompose the transmit aperture into equal power segments which necessarily contain different numbers of radiating elements for a tapered illumination. This requires phase shifters downstream from the transmit amplifiers introducing one-way losses of 1 dB or more.

One purpose of the invention is to provide an electronically scanned phased array antenna for radiating low sidelobe beams using identical solid state modules without the aforementioned disadvantages.

Another purpose of the invention is to provide a phased array antenna which employs identical modules to achieve radiation patterns having low sidelobe levels, and avoids the need for lossy phase shifters between the transmit amplifiers and radiating elements.

SUMMARY OF THE INVENTION

The foregoing and other purposes and features are provided by the invention in a phased array employing a uniform corporate feed network coupled to 2N radiating elements. In a first embodiment, the corporate feed network divides the array input signal into N feed outputs of equal power and phase. N beam steering phase shifters are coupled to corresponding ones of the feed outputs. A first set of N main radiating elements are spaced apart to form a linear main radiating aperture.

Second and third sets of N/2 ancillary radiating elements are disposed in respective spaced relationships to each end of the main aperture to form first and second ancillary element radiating apertures.

In a second embodiment, the ancillary elements are disposed at only one end of the main aperture.

The main element and ancillary element apertures in both embodiments form a linear composite array aperture. Means are provided for coupling each phase shifted feed output to a main radiating element and corresponding one of the ancillary radiating elements such that a uniform phase gradient is invoked between the respective elements of the main element aperture and the respective elements of the ancillary element apertures. Bi-state phase correctors are employed to correct the phase of the respective signals applied to the ancillary elements to achieve phase continuity between the respective adjacent elements of the main aperture and the ancillary aperture. The coupling means, the beam steering phase shifters and the bi-state phase correctors preferably form N modules. By appropriate control of the beam steering phase shifters and the bi-state phase shifters, the beam generated by the array may be scanned through a set of discrete angles.

In another embodiment, the array further comprises circulator/duplexers, low noise amplifiers and additional coupling elements to eliminate the lossy high power bi-state phase correctors and provide two receive channels. In another embodiment, a two-dimensional array system is provided, by which the signal driving each main element is coupled to two ancillary elements and in yet another embodiment, a two-dimensional array is provided by which the signal driving each main element is coupled to three ancillary elements. In each of the embodiments, substantially identical modules are used so that they are interchangeable with others within the embodiment.

BRIEF DESCRIPTION OF THE DRAWINGS

These and other features and advantages of the present invention will become more apparent from the following detailed description of exemplary embodiments thereof, as illustrated in the accompanying drawings, in which:

FIG. 1 is a schematic circuit diagram depicting a transmit array comprising N basic elements combined with N additional elements to provide an extended array of 2N elements fed by an array of phase shifters connected to a uniform corporate feed.

FIG. 4 is a simplified array beam pattern illustrative of beams which may be formed from the basic array of FIG. 1 when the phase shifters provide the same discrete phase gradients as an N element Butler or multiple beam matrix.

FIG. 5 is a simplified array beam pattern illustrative of the discrete beams using the discrete Butler phase shifts which may be formed with the extended array of FIG. 1.

FIG. 13 is a schematic depiction of the connections between the basic arrays of a two dimensional array and the ancillary arrays employed in accordance with the invention.

FIG. 14 is a simplified schematic diagram of the interconnected apertures forming the two dimensional array of FIG. 13.

DETAILED DESCRIPTION OF THE DISCLOSURE

Figure 2:
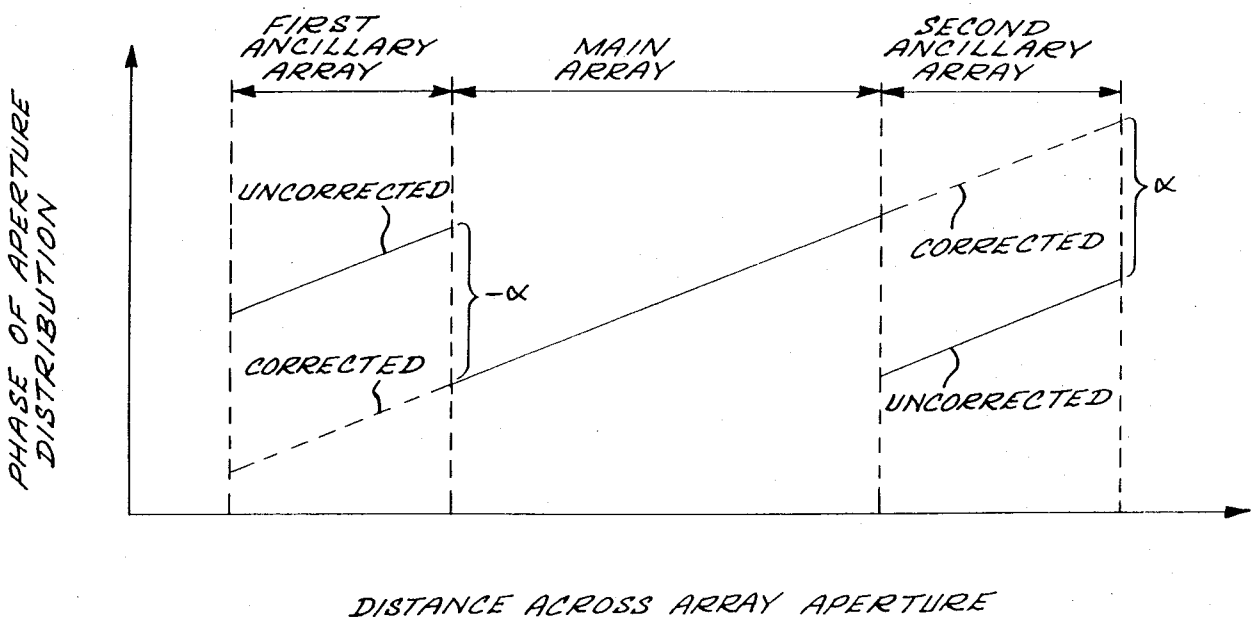
FIG. 2 is a plot of the phase of an exemplary aperture distribution for the extended array of FIG. 1, illustrating the phase correction supplied by the invention between the main aperture and ancillary apertures to achieve a continuous linear phase progression over the aperture.

The basic operating principles of the invention may be better understood by considering first a transmit array 50 as shown in FIG. 1. A uniform corporate feed 55 with outputs 56–59 of equal amplitudes and phases feeds an array of N phase shifters 60–63 and N radiating elements 72–75. The number N is assumed to be even in the following discussion of the preferred embodiment.

Although the term "transmit" has been used in various places herein, those skilled in the art will recognize that reciprocity dictates an identical or at least similar operation in a receive mode. Therefore, the term "transmit" is used in those instances only for convenience of description and may in fact include the operation of receive. Likewise the term "radiative" may also include "receptive"

Phase shifter 60 has a coupler 80 which feeds elements 72($R_1$) and 76($R_{N+1}$), phase shifter 61 has a coupler 81 which feeds elements 73($R_2$) and 77($R_{N+2}$), phase shifter 62 has a coupler 82 which feeds elements 74 and 70, and phase shifter 63 has a coupler 83 which feeds elements 75 and 71.

Phase correctors 85–88 respectively couple element 70 to coupler 82, element 71 to coupler 83, element 76 to coupler 80, and element 77 to coupler 81. Each serves to provide a phase shift $\alpha$ between the respective pairs of elements.

Array controller 40 provides control signals to the respective phase shifters 60–63 and 85–88 to control the respective phase shifts introduced by these elements.

The array comprising radiating elements 72–75 may be viewed as forming a main element aperture, the array comprising elements 70 and 71 a first ancillary array aperture, and the array comprising elements 76 and 77 a second ancillary array aperture. If a phase gradient $\psi$ between the radiating elements is invoked in the beam steering phase shifters 60–63, the same gradient exists at all three apertures. However, there is a phase discontinuity at the boundaries between the main array aperture and the two ancillary apertures. This phase discontinuity is illustrated in FIG. 2, where the solid lines depict the phase of the array aperture distribution as a function of distance across the aperture. The phase correctors 85–88 are provided to adjust the phases at the ancillary elements 70,71, 76, 77 to eliminate the phase discontinuity. The magnitude of the phase shift $\alpha$ of the phase correctors 85–88 is chosen to produce phase continuity between elements 71($R_0$) and 72($R_1$), and between elements 75($R_N$) and 76($R_{N+1}$), resulting in a continuous linear phase across the resultant array aperture comprising the main aperture and the first and second ancillary apertures. The corrected phase of the first and second ancillary apertures is illustrated by the dotted lines in FIG. 2. Further, the beam produced by the resultant aperture may be scanned in space by varying the beam steering phase gradient $\psi$ and the correcting phase shift $\alpha$.

The coupling values of the couplers 80–83 may be chosen to produce a tapered aperture illumination which satisfies the energy conservation relation between amplitudes $A_n$ and $A_{n+N}$ (arising from the couplers) at elements n and n+N, $$A_n^2 + A_{n+N}^2 = \text{constant}, \; -\frac{N+1}{2} < n < \frac{N+1}{2}$$

Figure 3:
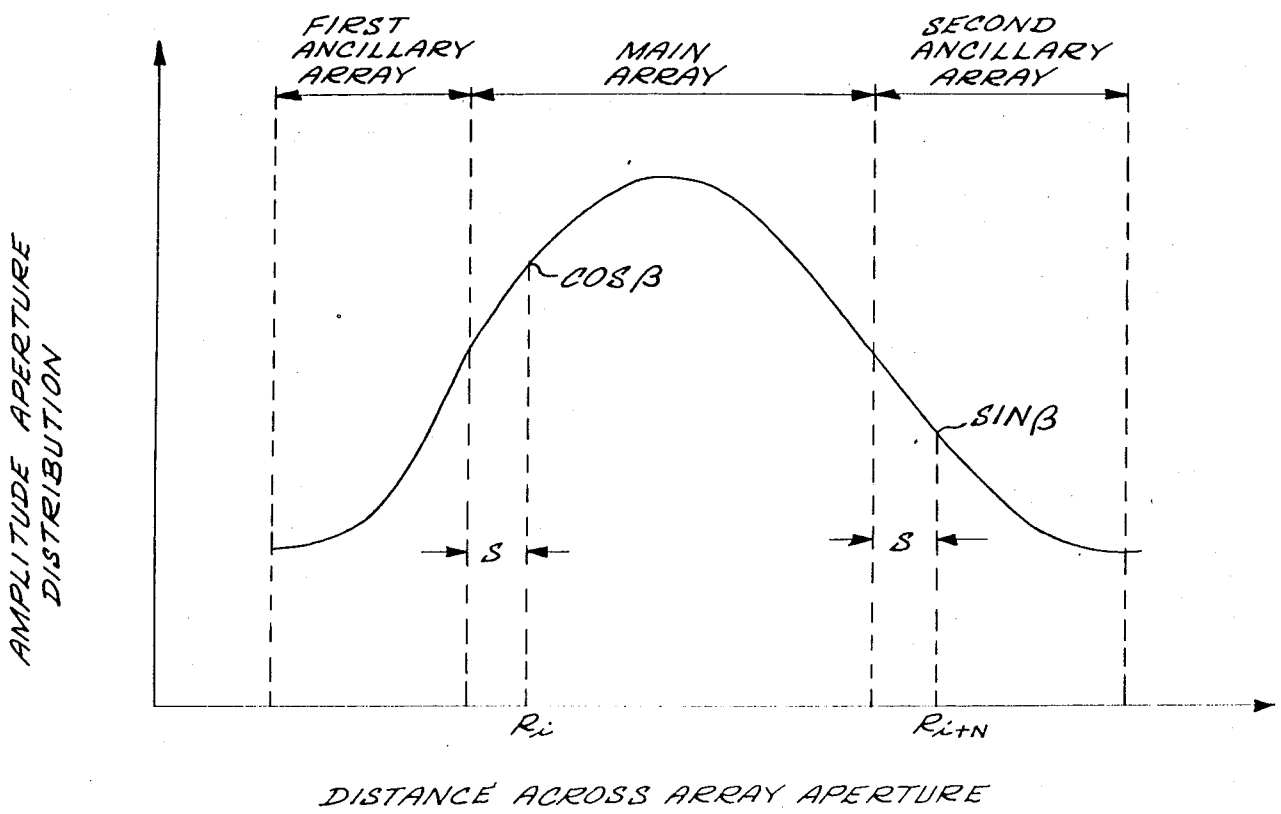
FIG. 3 is a plot of the amplitude of an exemplary tapered amplitude distribution for the extended array of FIG. 1, illustrating the respective amplitude from a main element and the corresponding coupled element.

The selection of the appropriate coupling values of the couplers 80–83 is illustrated in FIG. 3, showing the amplitude of an exemplary tapered aperture distribution as a function of distance over the aperture of the array of FIG. 1. This exemplary distribution is a tapered one for achieving low sidelobes in the array pattern off the beam. The position of exemplary element $R_i$ is indicated in FIG. 3, as is the position of the corresponding element $R_{i+N}$ in the second ancillary array which is coupled to element $R_i$. Given the desired distribution and the positions of the radiating element, the desired amplitudes at each radiating elements is readily obtained. The required coupling factor may be calculated from the desired corresponding amplitudes of the respective elements. For example, in FIG. 3 the distribution amplitude at element $R_i$ varies as $\cos\beta$, while the amplitude at element $R_{i+N}$ varies as $\sin\beta$, with $\beta$ representing the power coupling factor of the coupler ($\cos^2\beta + \sin^2\beta = 1$).

In the general case, the phase progression between elements and the phase correction $\alpha$ may be selected to scan the array beam at any desired beam angle. The corresponding values of the phase shift $\alpha 0$ necessary for a continuous linear phase across the extended aperture may be calculated in the following manner. The output voltage at each radiating element for uniform amplitude and constant phase progression $\psi$ is $V_n = e^{j(n-\bar{n})\psi} n = 1, \ldots N, \bar{n} = (1+N)/2$ (1)

Smooth phase progression requires $$\frac{V_{N+1}}{V_N} = e^{j\psi} \text{ where} \quad (2a)$$

$$V_{N+1} = V_1 e^{j\alpha} \quad (2b)$$

Substituting Eq. 1 with n equals 1 or N, and Eq. 2b into Equation 2a yields the relation of Eq. 3.

$$e^{j(N\psi-\alpha)} = 1 \quad (3)$$

To satisfy Eq. 1 for arbitrary $\psi$, the phase correctors 85–88 are variable over the range 0°–360°. At the current state of the art, such phase shifters are available, but may introduce significant losses which are undesirable for some applications.

The phase correctors 85–88 can be simplified or eliminated for a particular set of values of the phase progression $\psi$, the phase shifts which are characteristic of the Butler matrix.

The uniform corporate feed 55 and the beam steering phase shifters 60–63 of FIG. 1 may be viewed as functioning as the equivalent of one portion of an N-port (N inputs and N outputs) Butler matrix. The corporate feed 55 and phase shifters 60–63 provide only a single beam at any given time, but different beams can be generated by changing the phase shift $\psi$ of the shifters 60–63. The general Butler matrix can produce simultaneously N equally spaced beams, each with a gain of N times the element gain. Butler matrices are well known in the art, and are described, for example, in "Multiple Beams from Linear Arrays," J. P. Shelton and K. S. Kelleher, IEEE Trans. Antennas and Propagation, Vol. AP-9, page 154, March 1961.

Eq. 1 set forth the phase relationship for the phase shifts which are characteristic of a Butler matrix $$\psi = \frac{2\pi}{N}(m - \bar{n}), \text{ with } \bar{n} = (1 + N)/2, m = 1 \ldots N \quad (4)$$

With these characteristic phase shifts, an array of N equally spaced radiating elements fed by an N port Butler matrix produces beams as shown in FIG. 4, i.e., sinx/x patterns with 4 dB crossover. By using the couplers 80–83 feeding 2N elements to form the extended apertures as shown in FIG. 1, and with the phase shifters 60–63 providing the set of phase shifts specified in Eq. 4, the resultant array aperture of FIG. 1 is twice as large as the Butler matrix and the beams directed in the same directions are approximately half the width (exactly half for all equal power splits), as indicated in FIG. 5 by the beams in solid lines. Beam crossovers are very low (at the nulls for equal power split couplers). J. P. Shelton, "Reduced Sidelobes for Butler Matrix Fed Linear Arrays," *IEEE Trans. Antennas and Propagation*, "Vol. AP-17, page 645, September, 1969.

To obtain full coverage over the scanned area, it is necessary to fill in the missing beams (shown in phantom lines in FIG. 5) using the beam steering phase shifts $$\psi = (2\pi/N)(m - \bar{n} + \tfrac{1}{2}) \; m = 1, \ldots N \quad (5)$$

If the progressive phases given by Eqs. 4 or 5 are substituted into Eq. 3, and multiples of $2\pi$ are discarded, then $\alpha = \pi$ or 0, respectively, if N is even and $\alpha = 0$ or $\pi$ if N is odd. In either case, N even or odd, it is necessary to have two phase states $\alpha = 0$ or $\pi$ in order to satisfy Eq. 5. Thus, the main element $R_n$ and the corresponding element $R_{n+N}$ or $R_{n-N}$ are either excited in phase for one set of beams ($\alpha = 0$) or out of phase for the second set of beams ($\alpha = \pi$. With $\psi$ and $\alpha$ so chosen, the phase is continuous between elements $R_0$ and $R_1$ as well. Thus, the phase correctors 85–88 for the special case of the Butler phase shifts specified by Eqs. 4 and 5 are simplified to bi-state phase correctors having the two possible states 0 and $\pi$.

The couplers 80–83 may be chosen to produce a tapered amplitude distribution and the progressive phase shift provided by the beam steering phase shifters 60–63 may be chosen to place beams at discrete angles $\theta$ given by $$kd \sin\theta = \psi \quad (6)$$

where d is the radiating element spacing, k is $2\pi/\lambda$, $\lambda$ is the wavelength, $\theta$ is the angle from the normal to the array, $\psi$ is given by Equations 4 or 5 and a is either 0 or $\pi$.

The loss incurred by the bi-state phase correctors 85–88 is typically 1 dB at the present state of the art. These devices can be eliminated by using phase to produce both the desired amplitude and phase $\alpha$. If the sidearms of a magic T coupler device are excited by two equal amplitude signals $1/(2)^{\frac{1}{2}}$ with phases $+\phi_1$ 1 and $-\phi_1$, the sum arm output is $\cos\phi_1$ and the difference arm output is $\sin\phi_1$, where $\phi_1$ is selected to produce the correct power split. This is depicted in FIG. 6 which illustrates a circuit which is the equivalent of one of the beam steering phase shifters 60–63 and the corresponding one Of the bi-state phase correctors 85–88 of FIG. 1.

Figure 6:
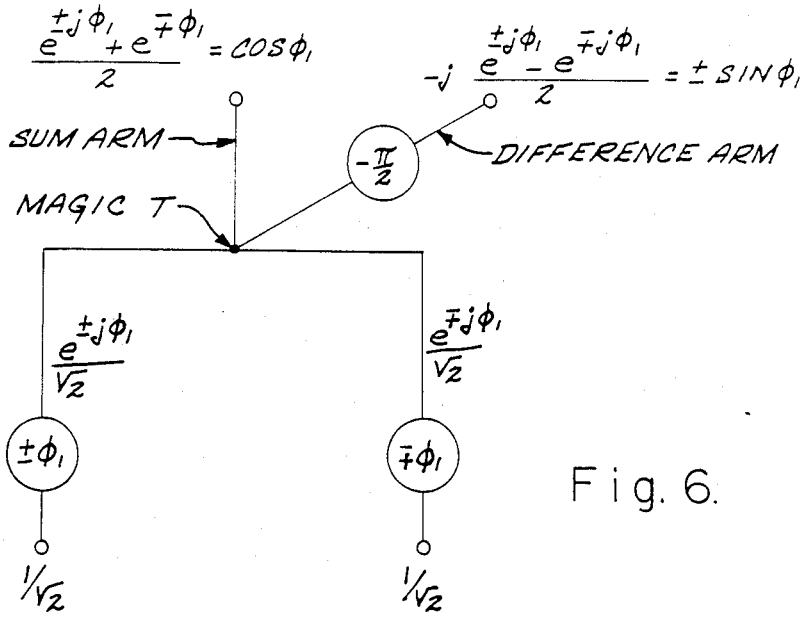
FIG. 6 depicts the usage of a Magic T power divider to achieve the desired phase and amplitude for each pair of elements in the extended array of FIG. 1.

The circuit of FIG. 6 utilizes a magic T four port coupler, a coupler which is well known to those skilled in the art, and described, for example, in "Microwave Antenna Theory and Design," edited by Samuel Silver, 1965, 1949, Dover Publications, at page 572. In the magic T circuit of FIG. 6, a fixed $\pi/2$ lag has been added such that both signals are real. If $\phi_1$ is replaced by $-\phi_1$, the sum signal remains the same at $\cos\phi_1$, but the difference arm signal changes sign; consequently the function of the coupler 80–83 in the previous discussion is determined by the choice of the magnitude of the phase $\phi_1$ and the function of the bi-state phase shifters 85–88 is determined by the sign of $\phi_1$. An alternate realization of this circuit is to replace the magic T with a quadrature hybrid function and program a fixed $\pi/2$ phase difference between the phase shifters which produce $\pm\phi_1$.

Figure 7A:
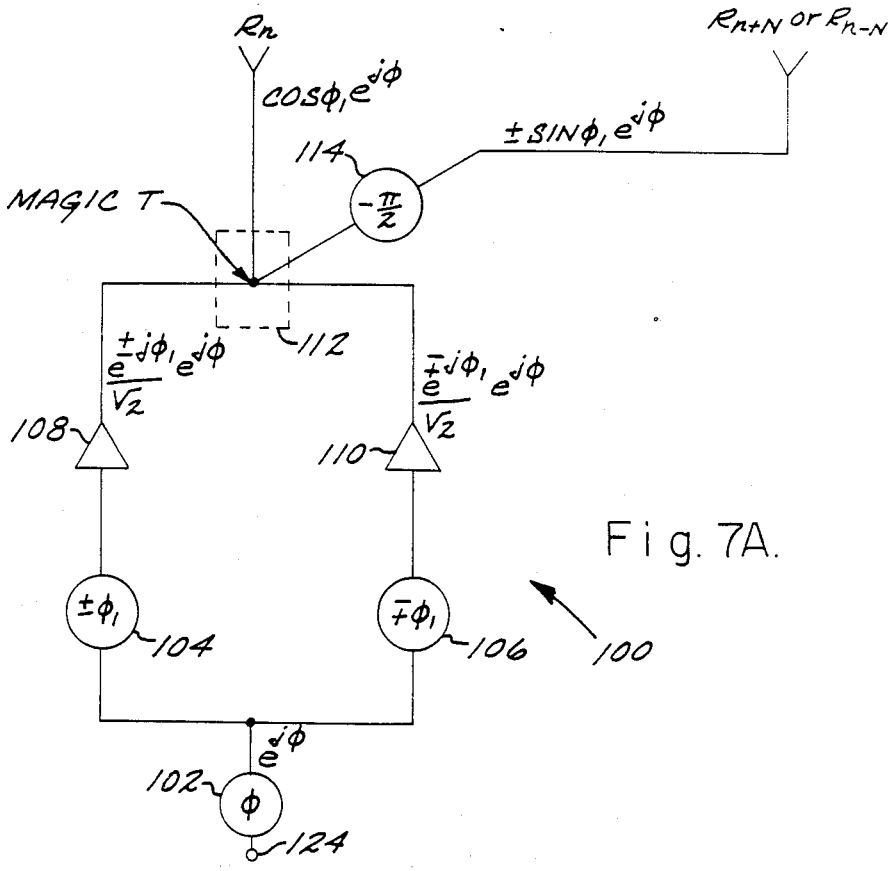
FIG. 7A is a simplified schematic diagram of one exemplary transmit module embodying one aspect of the invention.

The basic modular building block 100 of the present invention for the transmit mode is shown in FIG. 7A. The module 100 comprises beam steering phase shifter 102 for providing one of the characteristic Butler phase shifts $\phi = n\pi(2m - 2\bar{n})/N$ or $n\pi(2m + 1 - 2\bar{n})/N$. Phase shifters 104 and 106 supply respective phase shifts of $\pm\phi_1$ and $\pm\phi_1$ to provide the power splitting and phase correction functions as described above with respect to FIG. 5.

The outputs of the phase shifters 104 and 106 are provided as inputs to identical solid state high power transmit amplifiers 108 and 110. The amplifier outputs are connected to respective sidearms of magic T coupler 112. The output of the sum arm of the magic T, the signal $\cos\phi_1 e^{j\phi}$ for a unit input signal at input port 124, is coupled to radiating element $R_n$. The output of the difference arm of the magic T is shifted in phase by $-\pi/2$ to provide the signal $\pm\sin\phi_1 e^{j\phi}$, coupled to radiating element $R_{n\pm N}$.

The beamsteering functions provided by the phase shifter 102 in FIG. 7A can be combined with the functions of the phase shifters 104 and 106; then only two phase shifters are required, one producing $\phi\pm\phi_1$ and the other $\phi\mp\phi_1$.

The utility of the module embodiment of FIG. 7A may be appreciated by considering several examples. The array controller 40 (shown in FIG. 7B) may control the phase $\phi$ of the beam steering phase shifters 102 of each module in accordance with Eq. 4 or Eq. 5 to steer the beam to the desired one of the 2N discrete beams. The magnitude of the phase shift $\phi_1$ of phase shifters 104 and 106 may be set to zero. The value $\phi_1$ selects the aperture distribution by controlling the relative power split between the main aperture radiative element and the corresponding ancillary aperture radiative element. With $\phi_1$ set to zero, no power is provided to the ancillary aperture elements ($\sin 0=0$) and the transmit signal power will be divided equally among the N radiative elements comprising the main element aperture.

A second illustrative example is the case for the phase shift $\phi_1=\pi/4$ radian or 45°. In this case, the power in the transmit signal at each module is divided equally between the main element and the corresponding ancillary element. Thus, a uniform aperture distribution is provided over the entire extended array of 2N radiative elements. This distribution maximizes the gain over a beam width which is one half that produced by the first example ($\phi_1=0$).

The phase value $\phi_1$ may be selected to provide the tapered illumination described above, which minimizes the sidelobe level of the resultant radiation pattern, as will be appreciated by those skilled in the art.

A further principal advantage of the embodiment of FIG. 7A is that substantially all signal power provided by the high power amplifiers 108 and 110 is delivered to the radiative elements, since there are no lossy devices between the amplifiers and the radiative elements.

Figure 7B:
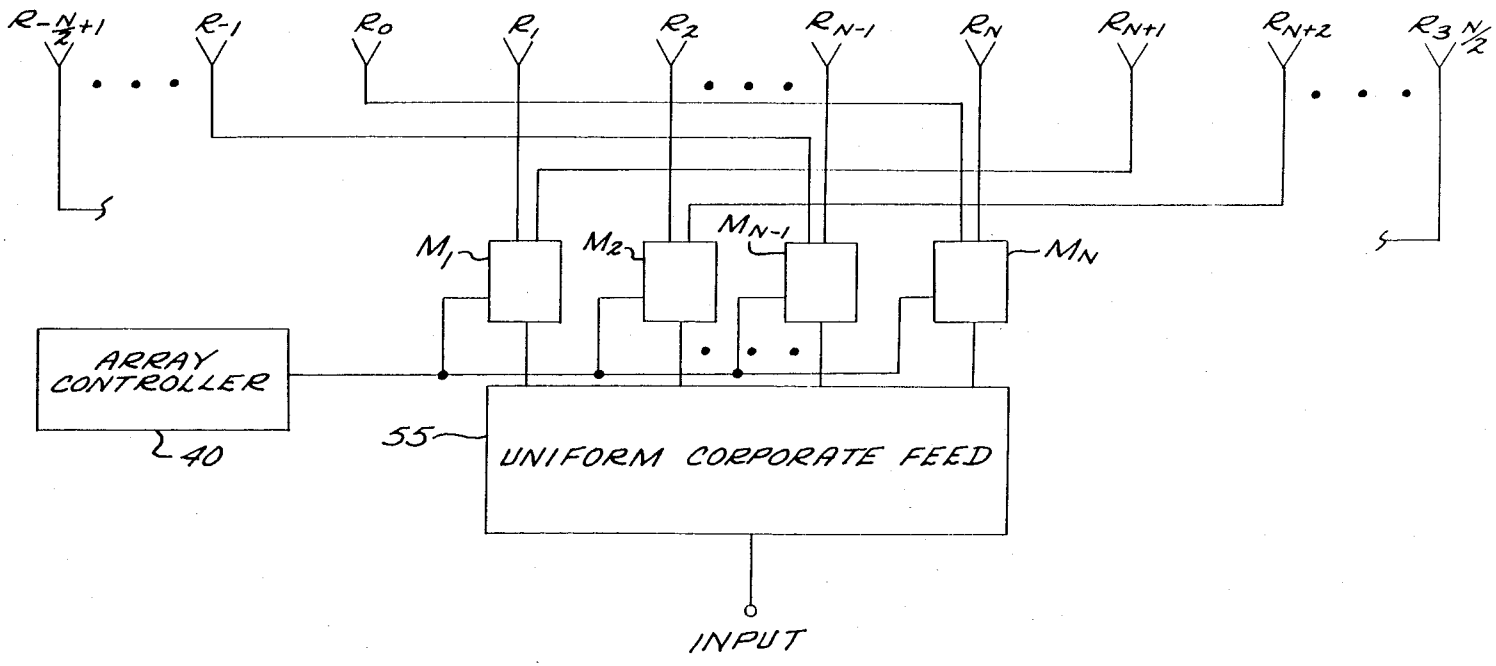
FIG. 7B is a schematic block diagram of an array system employing the transmit modules depicted in FIG. 7A.

FIG. 7B illustrates a line source transmit array employing N transmit modules $M_1$ to $M_N$, each comprising a module as described in FIG. 7A. The array of FIG. 7B is similar to that of FIG. 1, except that the transmit modules $M_1$ to $M_N$ have replaced the separate beam steering phase shifters 60–63, the couplers 80–83 and the bi-state phase correctors 85–88. Thus, the uniform corporate feed network 55 divides the single input signal into N network output signals of equal amplitude and phase. Each of the modules $M_1$ to $M_N$ is identical to the others.

Even with ideal elements there is a limit to the sidelobe level which can be produced by modules strictly of the form shown in FIG. 7A. This arises because of the constraint imposed by the magic T couplers 112 on the aperture distribution. This constraint may be written in the following form for a continuous symmetrical distribution over an aperture of length D.

$$A^2(x) + A^2\left(\frac{D}{2} - x\right) = 2A^2\left(\frac{D}{4}\right), \tag{7}$$

where x represents distance along the aperture.

Figure 8A:
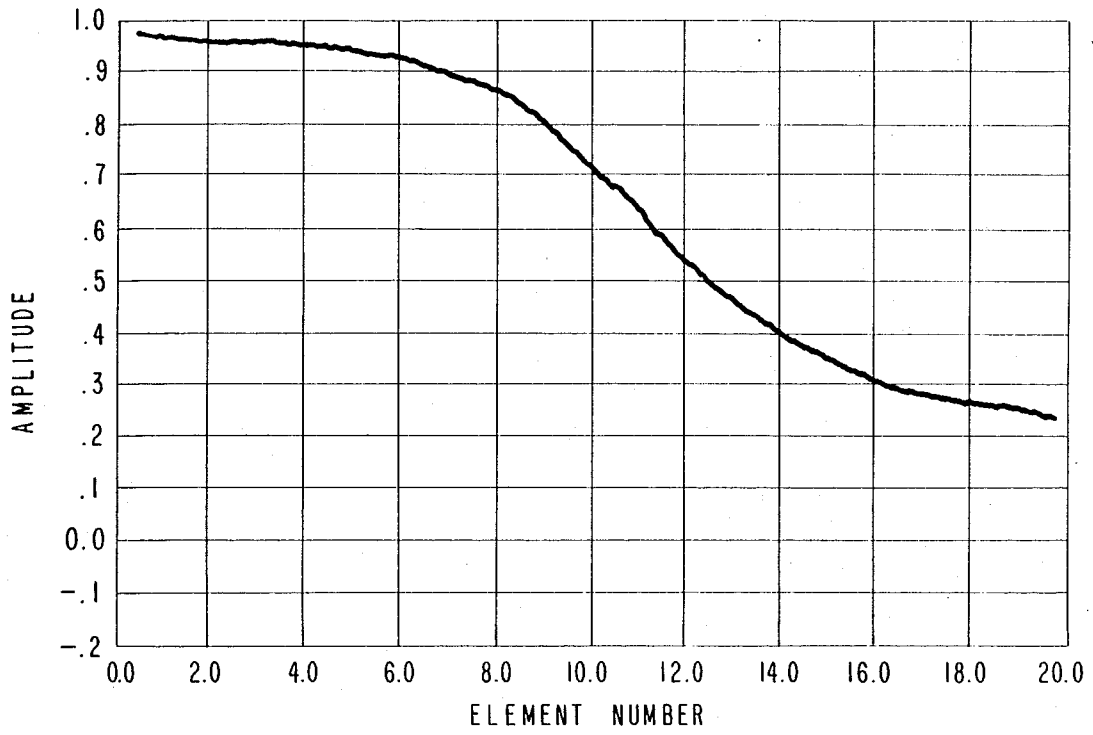
FIG. 8A is a plot of the amplitude of an exemplary tapered amplitude distribution for the extended array of FIG. 1 resulting in the 27.5 dB sidelobes shown in FIG. 8B, and which were obtained by trial and error.
Figure 8B:
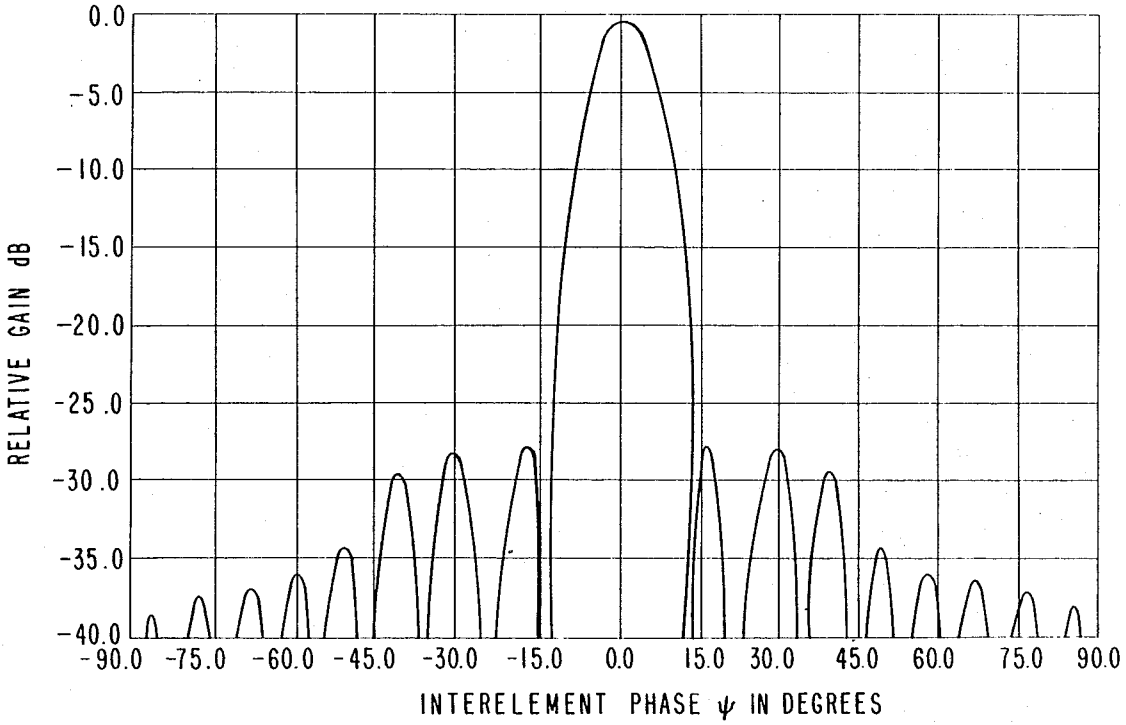

For example, the cosine distribution $$A(x)=\cos(\pi x/D) \tag{8}$$

satisfies the constraint and produces 23 dB sidelobes. A second aperture distribution is shown in FIG. 8A and produced the 27.5 dB sidelobes shown in FIG. 8B. These results were obtained using a trial and error technique. Those skilled in the art may use more sophisticated trial and error techniques to achieve lower sidelobes. However, a condition will ultimately be reached where sidelobes cannot be lowered further without excessive beam broadening and lower gain.

In this case, the use of slight loss may produce lower sidelobes with higher gain as follows.

For a desired distribution B(x) (such as Taylor distribution which does not satisfy the constraint of Equation 7), there is an optimum distribution A(x) satisfying Equation 7 which may be modified by attenuation to produce B(x) with maximum efficiency. It can be shown that this distribution is given in terms of a function $\gamma(x)$ as follows:

$$A(x) = \sin\gamma(x)\ 0 \leqq x \leqq D/4 \tag{9a}$$

$$= \cos\gamma(D/2 - x)\ \frac{D}{4} \leqq x \leqq \frac{D}{2} \tag{9b}$$

$$\tan\gamma(x) = B(x)/B(D/2 - x)\ 0 \leqq x \leqq \frac{D}{4}$$

The resulting efficiency is:

$$\text{Efficiency} = (4K^2/D)\int_0^{D/2} B^2 dx. \tag{10}$$

Where $1/K^2$ is the minimum value of $B^2(x)+B^2(D/2-x)$ in the interval $0\leqq x\leqq D/2$. For example, if $B(x)=\cos\pi x/D$, $\gamma=\pi/2-\pi x/D$, $A(x)=B(x)$ and there is no loss. For a 32 dB Taylor series distribution $\bar{n}=4$ distribution calculations show the efficiency loss is $-0.48$ dB, a small price to pay in most practical cases.

Figure 9:
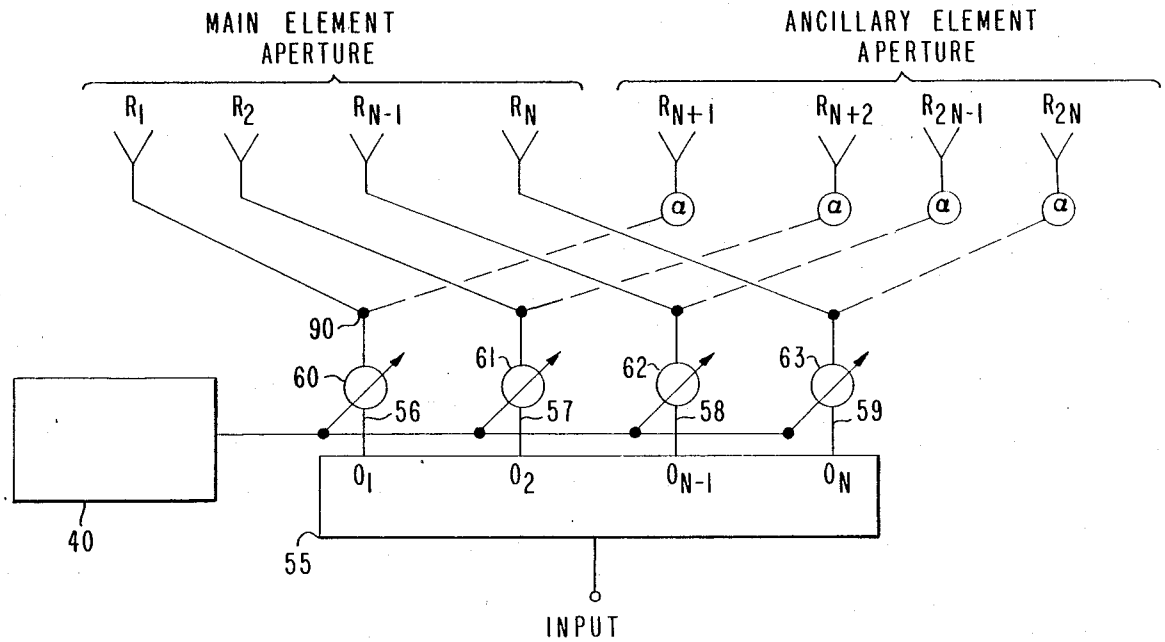
FIG. 9 is a schematic circuit diagram depicting another line source embodiment comprising N basic elements combined with N additional elements to provide an extended array of 2N elements in a side-by-side configuration.

Another line source embodiment is shown in FIG. 9. In this embodiment, half of the circuit of FIG. 1 has been deleted. This embodiment comprises N main elements and N ancillary elements. In this embodiment, N need not be even. Pairs of elements, e.g., $R_1$ and $R_N+1$, are interconnected through a coupler, such as that designated by numeral 90 and $\alpha$ phase shift is used with the ancillary elements in a manner correspondingly similar to that described above for FIG. 1. The embodiment of FIG. 9 is not restricted by the even number of elements requirement of FIG. 1. In FIG. 1, the surrounding of main elements by ancillary elements requires that an even number of main elements be used, i.e., a number divisible by four, since an unbalance would occur with a different number of elements in the first ancillary aperture from that number in the second ancillary aperture. The embodiment of FIG. 9 has no such restriction and any number of main elements may be used.

The discussion of the operation of the embodiment of FIG. 1 is applicable to the embodiment of FIG. 9 except that the phase of aperture distribution across the array aperture will have only one discontinuity as opposed to the two discontinuities shown in FIG. 2. That discontinuity, however, is corrected by means corresponding to the correction between the main array and the second ancillary array of the embodiment of FIG. 1.

Figure 10A:
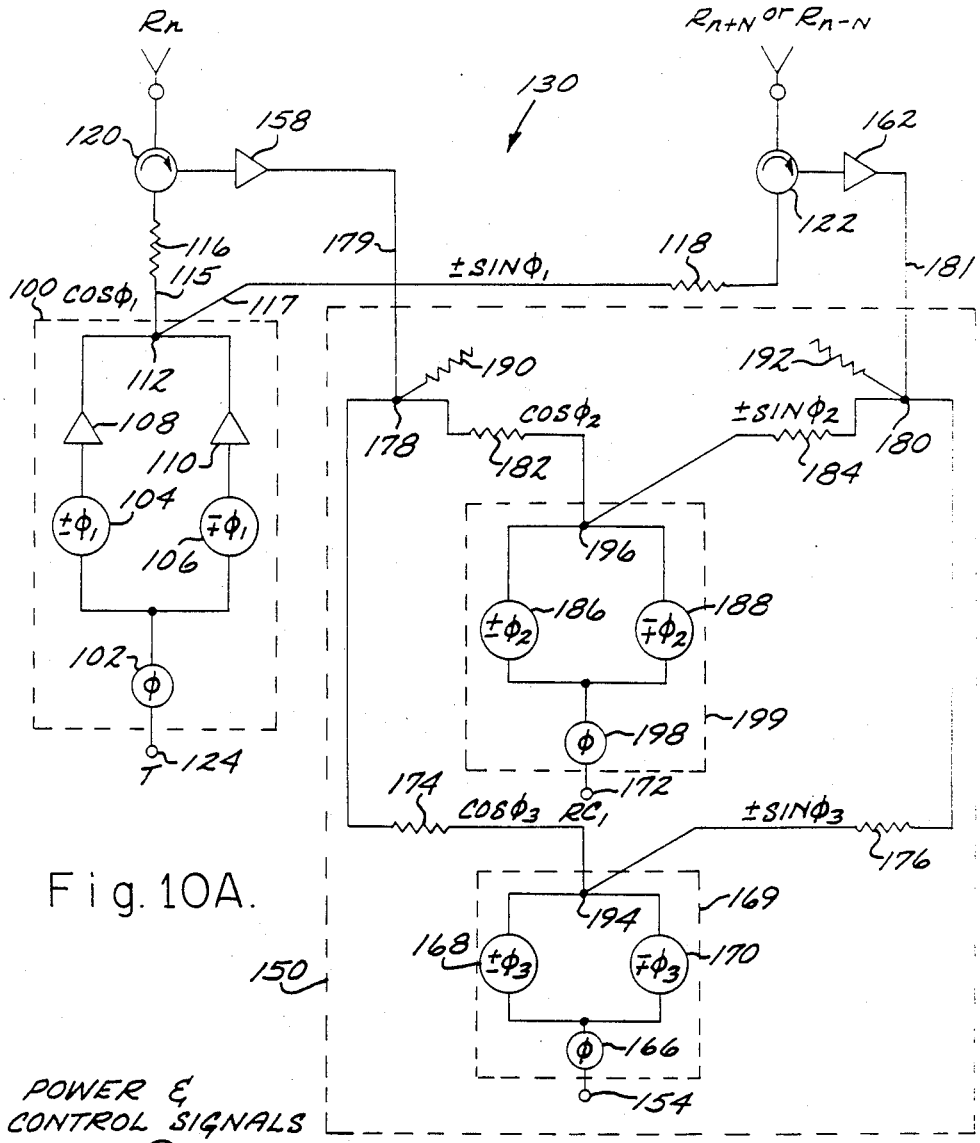
FIG. 10A is a simplified schematic diagram of an exemplary transmit/receive module for monopulse operation.
Figure 11:
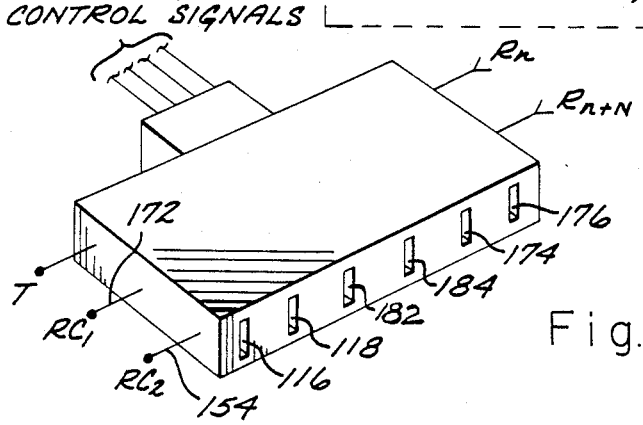
FIG. 11 is a schematic diagram and a perspective view of a solid state transmit/receive module package in accordance with the invention.
Figure 10B:
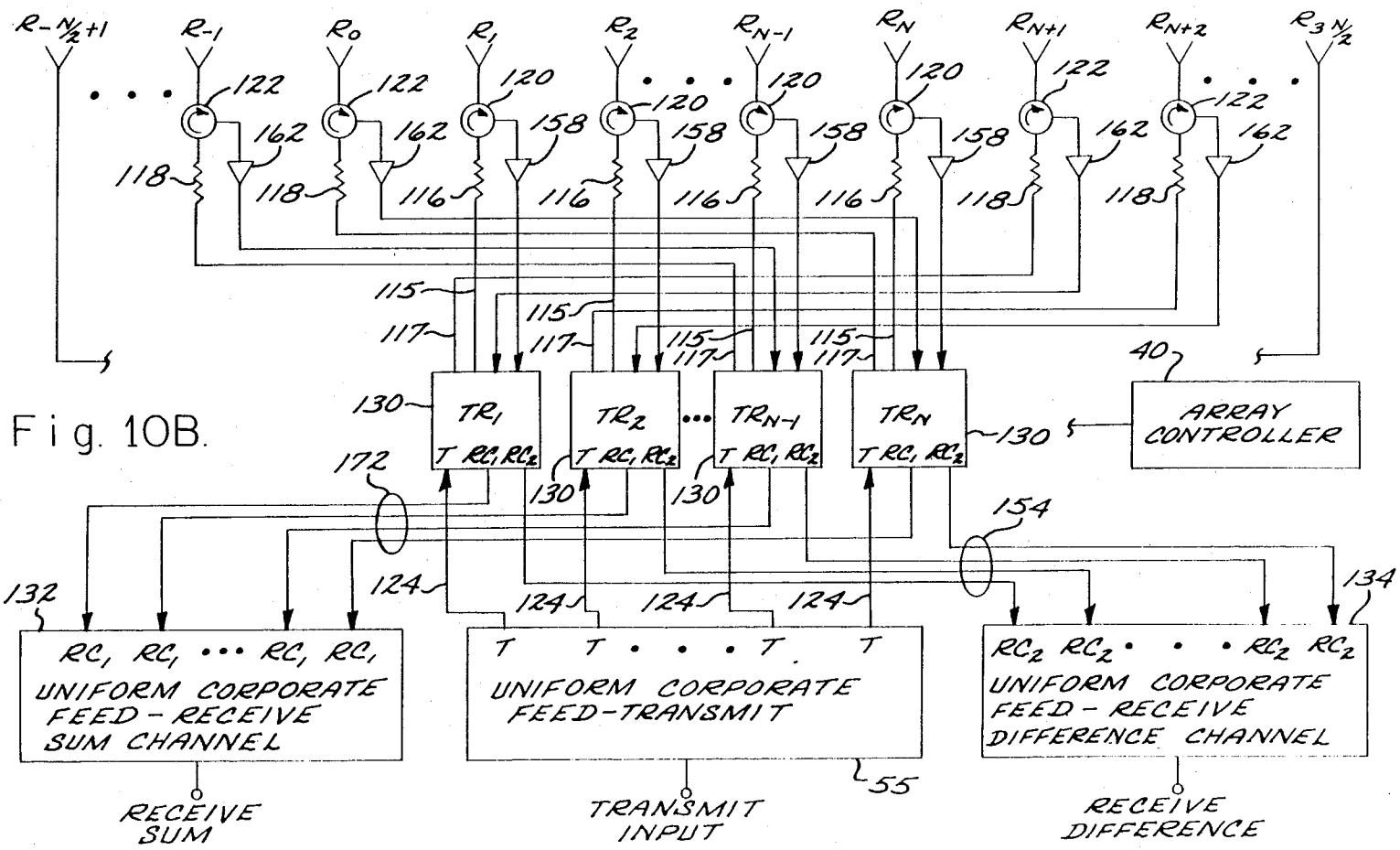
FIG. 10B is a schematic block diagram of an array system employing the transmit/receive modules depicted in FIG. 10A.

A planar array embodiment of the invention suitable for transmit and receive operation is shown in FIGS. 10A, 10B and 11. To provide the capability for the monopulse receive mode, circulator/duplexers and low noise amplifiers are inserted near each radiating element of the array. With sufficient gain, these amplifiers establish the signal-to-noise ratio such that lossy power division and attenuation can be used downstream without penalty. An exemplary transmit/receive (T/R) module 130 is shown in FIG. 10A. The T/R module 130 comprises transmit module section 100 (depicted in FIG. 7A). Transmit signals from the transmit corporate feed 55 are provided as inputs to transmit input port 124 of each T/R module. The module sections 100 are coupled to radiating elements $R_n$ and $R_{n\pm N}$ via respective attenuators 116, 118 and circulators 120, 122.

The receive section 150 of module 130 is coupled to the radiating elements $R_n$ and $R_{n\pm N}$ via circulator/duplexers 120, 122 and low noise amplifiers 158, 162. The section 150 provides receive sum and difference signals at ports 172, 154. The outputs from amplifiers 158, 162 are respectfully coupled to the sum arm and to the difference arm of magic T couplers 178, 180 of the receive section 150. The difference arm and the sum arm of these respective couplers are terminated in matched loads 190, 192. One sidearm of magic T coupler 178 is coupled through attenuator 174 to the sum port of magic T coupler 194; the other sidearm of magic T coupler 178 is coupled through attenuator 182 to the sum arm of magic T coupler 196. Similarly, one sidearm of magic T coupler 180 is coupled through attenuator 176 to the difference arm of magic T 194; the other sidearm of magic T coupler 180 is coupled through attenuator 184 to the difference arm of magic T coupler 196.

The outputs of the sidearm of magic T coupler 194 are respectively phase shifted by $\pm\phi_3$ (phase shifter 168) and $\mp\phi_3$ (phase shifter 170) and combined. The resultant signal is phase shifted by the beam steering phase shift $\phi$ (phase shifter 166) to provide the receive difference signal at port 154.

The outputs of the sidearms of magic T 196 are respectively phase shifted by $\pm\phi_2$ (phase shifter 186) and $\mp\phi_2$ (phase shifter 188) and combined. The resultant signal is phase shifted by $\phi$ degrees by beam steering phase shifter 172 to provide the receive sum signal at sum port 172. The circuitry enclosed by phantom lines 169 and 199 in FIG. 8A is functionally similar to transmit circuit 100 with the amplifiers 108, 110 omitted.

The power splitting and phase correcting phase shift devices 104, 106, 168, 170, 186, and 188 are respectively controlled by an array controller (not shown) to select the appropriate one of the two states of these phase shifters to form the desired beam.

Independent transmit, receive sum and receive difference channel patterns are obtainable by choosing the phase shifts $\pm\phi_1$, $\pm\phi_2$, and $\pm\phi_3$ and the attenuation levels of attenuators 116, 118, 182, 184, 174 and 176 (if necessary at all for ultra low sidelobes). All modules in an array are preferably identical, except for these attenuators. The phase shifts $\pm\phi_1$, $\pm\phi_2$, and $\pm\phi_3$ are determined by computer software control, and are variable during operation to produce different patterns, should that be desired for clutter or interference rejection purposes. Thus, the respective phase shifts $\phi_1$, $\phi_2$, $\phi_3$ may be independently selected to achieve desired aperture amplitude distributions for the respective transmit, receive sum and receive difference patterns.

FIG. 10B is a schematic diagram of an array system employing the transmit/receive modules 130 depicted in FIG. 10A to provide transmit, receive sum and receive difference channels. In this example, the 2N radiating elements are coupled to the transmit corporate feed network 55 by the transmit/receive modules $TR_1-TR_N$. Each radiating element has a particular duplexer, attenuator and low noise amplifier set (122, 118, 162 or 120, 116, 158) associated with it, as shown in FIG. 10A.

The respective outputs 172, 154 of each transmit/receive module $TR_1-TR_N$ are coupled to the respective uniform corporate feed networks 132 and 134 to provide the receive sum channel and receive difference channel signals, respectively. The networks 55, 132 and 134 are identical.

The modules $TR_1-TR_N$ of FIG. 10B may be fabricated as identical modules whose physical configuration is illustrated generally in the schematic perspective view of FIG. 11. The module includes RF connections for the transmit signal input T, the two receive signals $RC_1$ and $RC_2$, and the connections to the radiating elements $R_n$ and $R_{n\pm N}$, power and control signal lines. In addition, the attenuators 116, 118, 182, 184, 174 and 176 may be provided in the form of plug-in elements. Further, the low noise amplifiers 158, 162 and circulators 120, 122 may be incorporated into the respective modules. Thus, each module is identical except for the value of the attenuators.

In the special case of uniform transmit illumination one can compare the use of this technique with the usual identical module per element approach. For this special case, both arrays produce the same patterns with 13 dB sidelobes, have the same number of transmit modules, circulator/duplexers, and low noise amplifiers. The array employing the present invention does have more passive circuitry and low power phase shifters. The array employing the invention, however, is able to produce a tapered aperture distribution and provide the low sidelobes not otherwise achievable with identical modules alone.

Figure 12A:
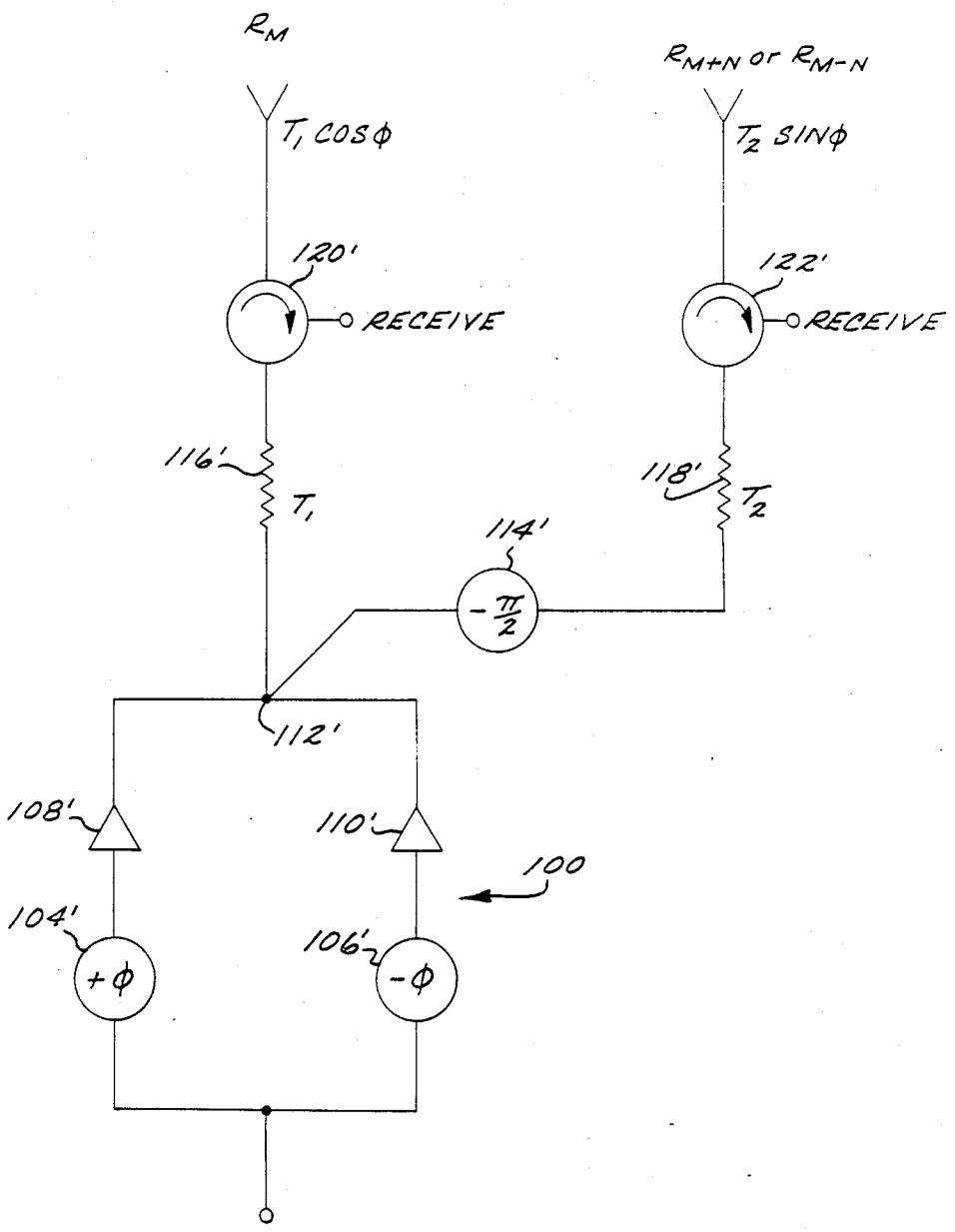
FIG. 12A–12C illustrate three respective embodiments of the basic transmit circuit employed in accordance with the invention.
Figure 12B:
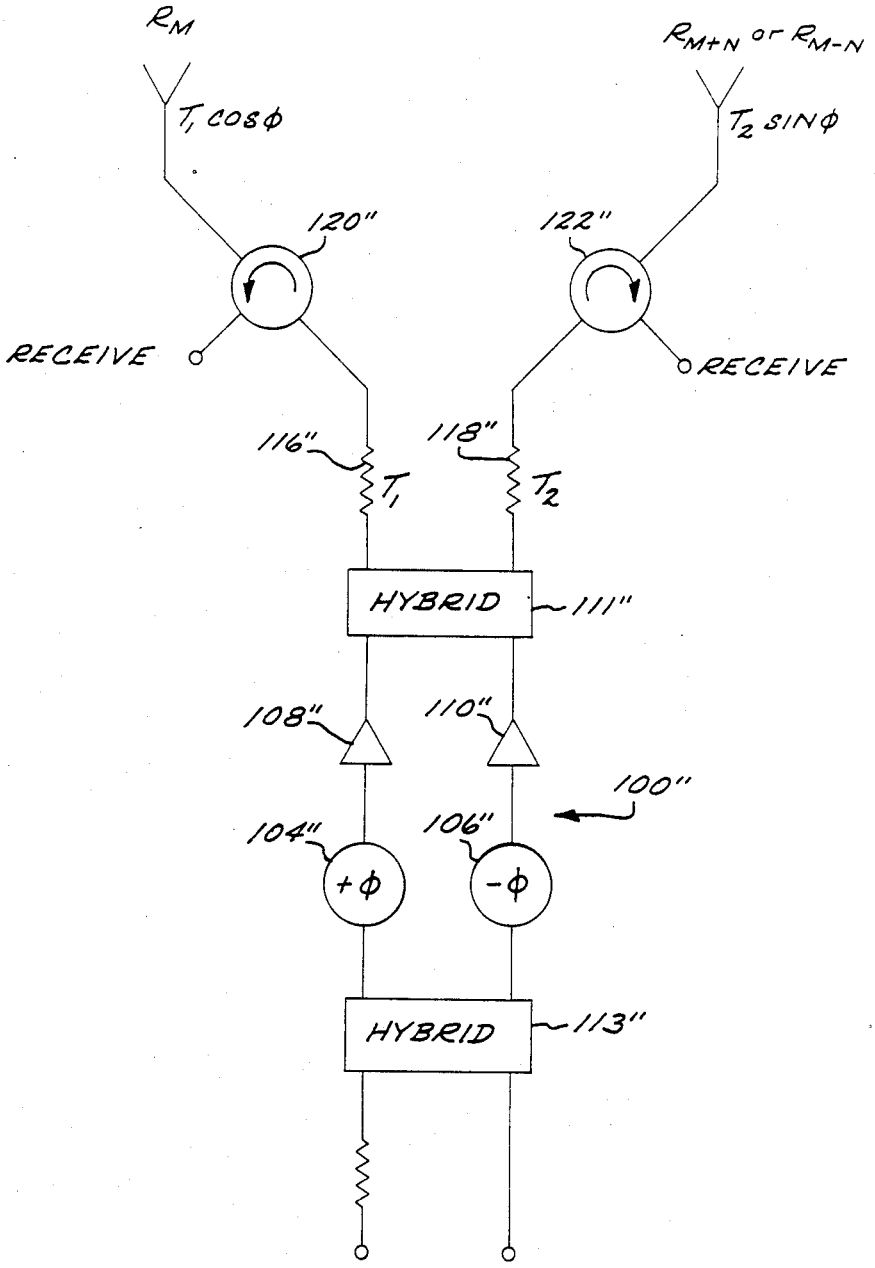

Alternate embodiments of the transmit circuit 100 which do not employ magic T couplers may be constructed using 90° hybrid couplers. FIG. 12A illustrates the basic transmit circuit 100 of FIG. 10A with circulators 120', 122' and attenuators 116', 118' added. FIG. 12B is a first alternate embodiment 100'' of the circuit representation of FIG. 12A which employs 90° (quadrature) hybrid couplers 111'' and 113'' in place of the magic T coupler 112', eliminating the need for the fixed phase shifter 114' of FIG. 12A. Further, quadrature hybrids are easier to construct in stripline or microstrip transmission lines than magic T couplers.

Quadrature hybrid couplers are well known to those skilled in the art, and comprise two pairs of ports. If one port of one pair is driven by a unit signal (i.e., of value one) then the power at the corresponding through port of the second pair will be $1/(2)^{\frac{1}{2}}$, the power at the coupled port of the second pair will be $-j/(2)^{\frac{1}{2}}$, and the power at the other port of the first pair will be zero. Thus, assuming a unit input to module 100'', one output coupled to radiative element $R_n$ has the amplitude $T_1\cos\phi$, and the output to the corresponding ancillary element $R_{n+N}$ or $R_{n-N}$ has the amplitude $T_2\cos\phi$, with $T_1$ and $T_2$ being the corresponding attenuation values for attenuators 116'' and 118'', and $\phi$ is the magnitude of the phase shift introduced by phase shifters 104'' and 106''.

Figure 12C:
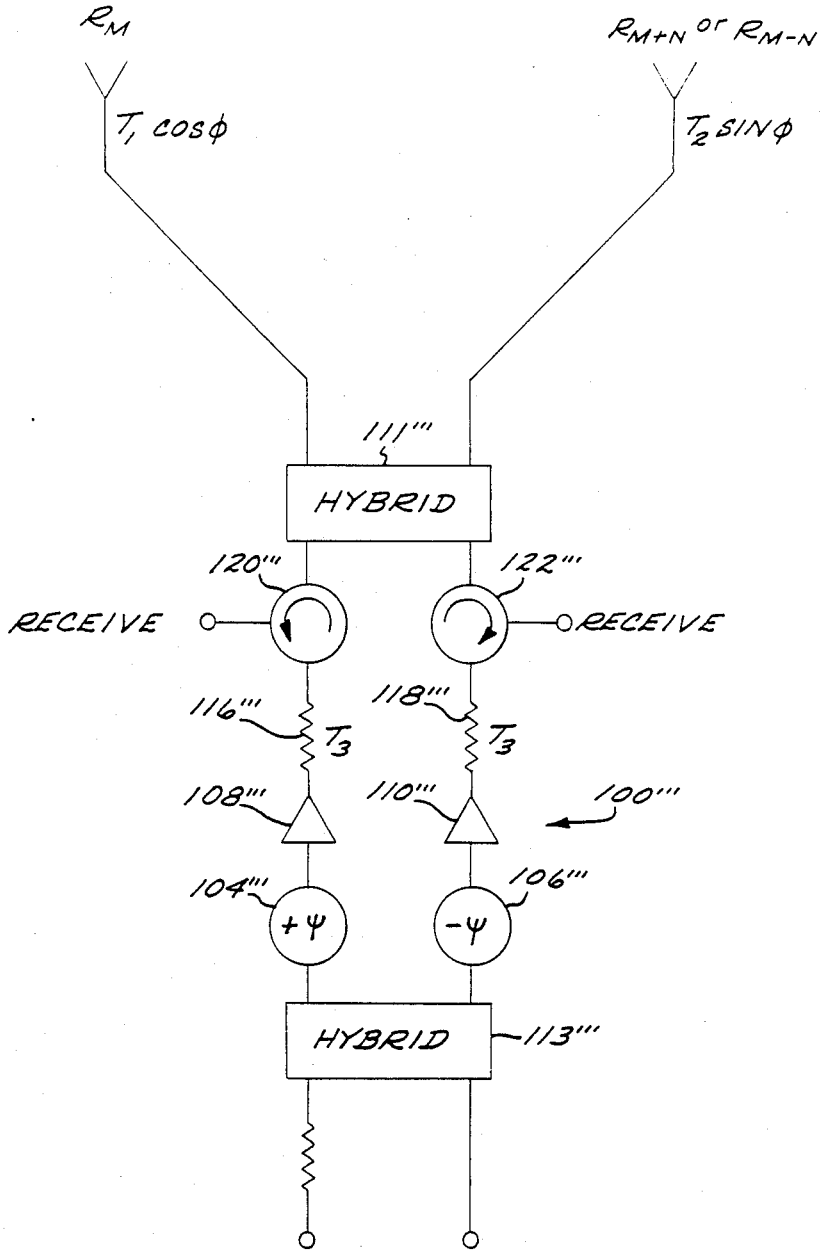

FIG. 12C illustrates a third embodiment 100''' of the transmit module which is a preferred embodiment because of practical hardware characteristics. In this embodiment, the circulators 120''' and 122''' and attenuators 116''' and 118''' are placed between the hybrid couplers 111''' and 113''', in contrast to the module configuration of FIG. 12B. This placement has several practical advantages. One advantage is that the circulators 120''' and 122''' carry the same power levels, whereas one of the circulators 120' and 122' of FIG. 12A or one of the circulators 120'' and 122'' of FIG. 12B may carry most of the power in highly tapered aperture distributions. Thus, the power rating of the circulators may be reduced by a factor of about 50%. A second advantage is that the attenuators 116''' and 116''' within a module have the same attenuation value relaxing phase tracking. Finally, residual tracking corrections are easier to implement in software for the circuit of FIG. 12C.

The attenuators $T_3$ in the embodiment of FIG. 12C have the attenuation value $T_3^2=T_1^2\cos^2\phi+T_2^2\sin^2\phi$. The magnitude of the phase shift of phase shifters 104''' and 106''' is $\psi=\tan^{-1}[(T_2\sin\phi)/(T_1\cos\phi)]$.

Figure 15:
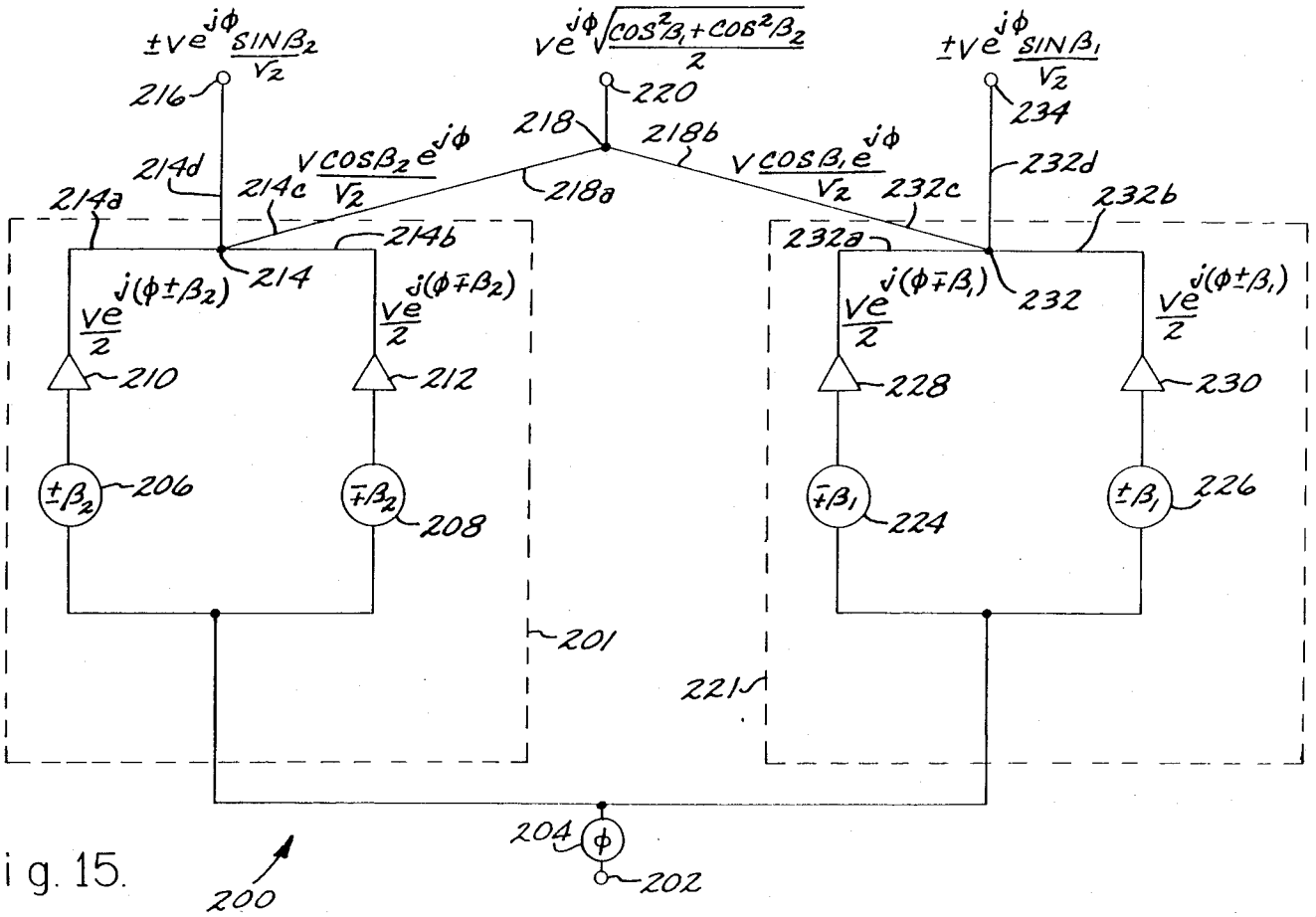
FIG. 15 is a simplified schematic diagram of an embodiment of a transmit module embodying the invention for the two dimensional array of FIGS. 13 and 14.

A third embodiment of the invention is depicted in FIGS. 13–15. This embodiment is a two-dimensional array, wherein the techniques described above respecting FIGS. 1–11 are extended to two dimensions. In FIG. 13, a basic planar array of NxL radiating elements is divided into four quadrants. Each radiating element in the basic array is coupled to two other elements at A(n,m). For basic element A(n,m) in the lower left quadrant, for example, one of the ancillary elements is located in an ancillary array at A(n+N,m), and the other element is A(n,m+L). The three elements are coupled by a three-way power divider, with $\beta_1$ representing the power division factor between the main element at A(n,m) and the ancillary element at A(n+N,m), and $\beta_2$ representing the power division factor between the main element and the ancillary element at A(n,m+L) . For unit power inputs, the basic element at A(n,m) may have output power $(\cos^2\beta_1+\cos^2\beta_2)/2$ and each of the two ancillary elements have power $\sin^2\beta_1/2$ and $\sin^2\beta_2/2$, respectively, thereby satisfying energy conservation at the three-way divider fitted to each basic element. Each quadrant may contain numerous radiating elements.

The choices of the division factors $\beta_1$ and $\beta_2$ of each basic element allow an amplitude taper to be applied to the array. Each basic element has two ancillary elements; therefore, the added area of the aperture is twice that of the basic area. The requirement of certain discrete phase shifters (for the special case discussed above of the characteristic Butler phase shifts) and the 0 or $\pi$ additional phase shifts necessary to obtain full volumetric coverage by a pencil beam are the same as for a linear array due to the separability of the beam-steering phases.

This technique is extended to the remaining three quadrants in the basic area producing a total aperture which has three times the area of the original basic array. The areas which are connected directly are shown in FIG. 14 where $A_n$ represents an element in the nth quadrant of the basic array and $B_n$ and $C_n$ are the ancillary areas.

The transmit building block 200 for the two-dimensional array is shown in FIG. 15, and requires two magic T couplers 214, 232, One combiner T 218, and four equal level power amplifier modules 210, 212, 228, 230. These elements are located in two substantially identical modules 201 and 221. In these modules, the amplifier modules 210, 212, 228, and 230 are also substantially identical. Also substantially identical are the phase shift devices 206, 208, 224, and 226. Their phase shift values may be controlled as shown in FIGS. 10B and 11.

Two high power amplifier modules 228, 230 of phases $\pm\beta_1$ and relative power $\frac{1}{4}$ each are combined in magic T 232 to produce outputs as $\cos\beta_1/(2)^{\frac{1}{2}}$and $\pm\sin\beta_1/(2)^{\frac{1}{2}}$, the latter output being connected at port 234 to an ancillary element.

The two high power amplifier modules 210, 212 are phased $\pm\beta_2$ and combined in magic T 214 to produce outputs as $\cos\beta_2/(2)^{\frac{1}{2}}$ and $\pm\sin\beta_2/(2)^{\frac{1}{2}}$, the latter being connected at port 216 to the other ancillary element.

The two sum outputs of respective magic Ts 214, 232 ($\cos\beta_1/(2)^{\frac{1}{2}}$ and $\pm\cos\beta_2/2$) are combined in a combiner T 218 to provide at port 220 the output power $(\cos^2\beta_1+\cos^2\beta_2)/2$.

The values of $\beta 1$ and $\beta 2$ are selected to provide the tapered amplitude distribution. Beamsteering is accomplished by the setting of the phase shift of phase shifter 204. Resistive loading may also be used for additional tapering and sidelobe reduction. The receive mode function of operation is obtained by inserting duplexers at each element and constructing circuits similar to the transmit circuit, as described above for the one dimensional (linear) array. Independent sum and difference patterns can be obtained as in the case of the linear array.

Figure 16:
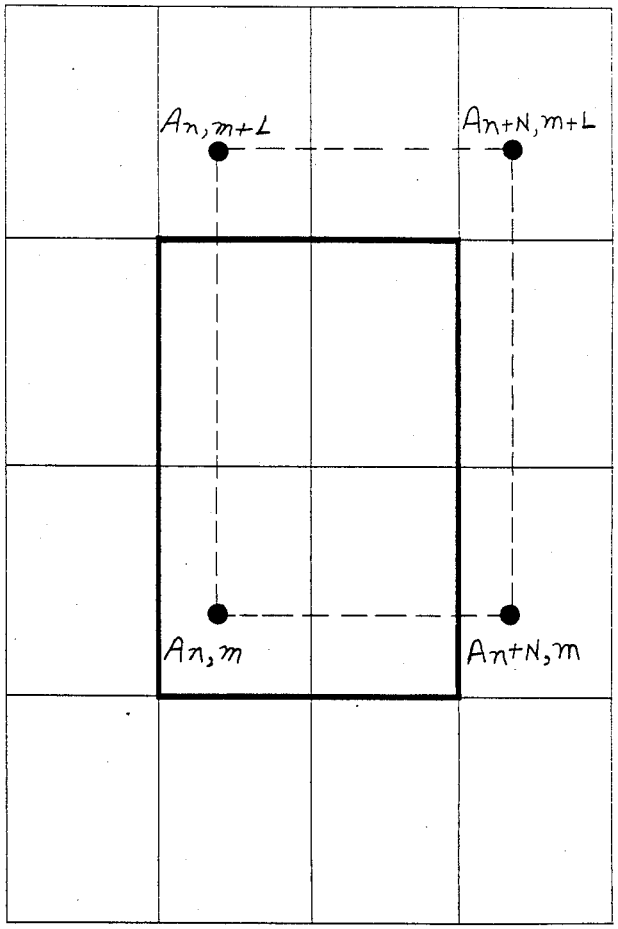
FIG. 16 is a simplified schematic diagram of an embodiment having one main element and three ancillary elements in a planar array.

Another planar array embodiment using three ancillary elements with each main element thereby forming a group of four elements is shown in FIG. 16. This allows a full rectangular aperture with a tapered, separable aperture distribution. An element, $A_{n,\ m}$ in the main array is connected to the same two elements as in FIG. 13 and $A_{n+N,\ m}$and $A_{n,\ m+L}$), but an additional ancillary element ($A_{n+N,\ m+L}$) is also employed. The entire array comprises quartets of elements disposed in the pattern shown in FIG. 16 except translated and/or rotated. The total area of the array is now four times greater than the main array.

The radiation pattern resulting from this embodiment has main sidelobes in the principal planes only (vertical and horizontal planes when the beam is broadside). Thus the 27.5 dB sidelobes for the linear array can be produced by this planar array as well.

Figure 17:
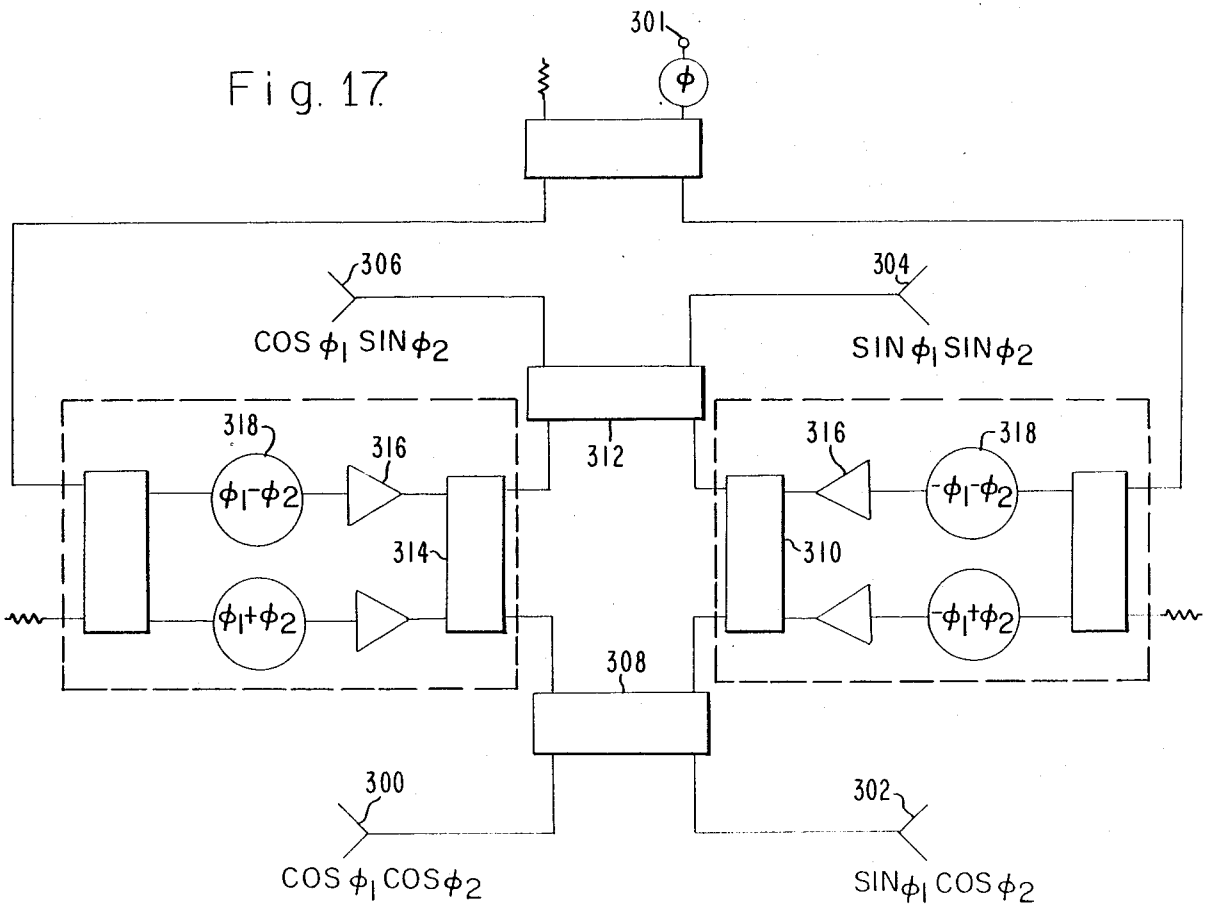
FIG. 17 is a simplified schematic diagram of an embodiment of a transmit module usable in the array of FIG. 16.

A simplified interconnection of four elements is shown in the module schematic, FIG. 17. The input is provided at terminal 301. Four elements 300, 302, 304, 306 are connected to 3 dB hybrid junctions 308, 310, 312, 314, which are connected in turn to amplifiers 316 and phase shifters 318. The phase shifter settings shown in FIG. 17 produce the four outputs indicated at the elements 300, 302, 304, 306 assuming unit input and disregarding amplifier gain. There is substantially no loss, and amplitude tapering can be modified by changing the phase shifters only. The input with unit magnitude may be phase shifted such that a beam comprising the contributions of each quartet can be steered in space in small discrete steps as in the previous planar array embodiment. Also the $\pi$ phase shifter requirement can be met by changing the sign of the $\phi_1$ and $\phi_2$ phases as required for beam steering in both planes. Duplexers may be added at the element level for independent receive beams, or between the amplifiers 316 and output hybrids 308, 310, 312, 314, just as in the linear array module of FIG. 12C.

A solid state electrically scanned phased array with low sidelobes (tapered aperture illumination) using identical solid state modules has been disclosed. The advantages of this invention include the following:

(1) Easier engineering design since only one module type need be considered.

(2) Lower production cost since the entire array is composed of only one module type.

(3) Improved phase and amplitude tracking between modules and improved radiation pattern performance since the modules are all identical and need only be built similarly to achieve the phase/amplitude tolerance.

(4) High efficiency transmitter operation since all transmit sections are identical and may be tuned for optimum performance (efficiency, bandwidth, gain, output power, low noise) while still maintaining the ability to achieve a tapered aperture illumination and consequent low sidelobes in both transmit and receive modes.

(5) Rapid (pulse to pulse in a radar) selectability of pattern characteristics, i.e., change beamwidth, sidelobe level, depending on system mode of operation, jamming and clutter environment.

(6) Amplitude and phase type adaptive nulling capability on receive.

It is understood that the above-described embodiments are merely illustrative of the possible specific embodiments which can represent principles of the present invention. Other arrangements may be devised in accordance with these principles by those skilled in the art without departing from the scope of the invention.

What is claimed is:

1. A phased array for scanning a narrow beam over a relatively wide angle, comprising:

means for dividing an input signal into N feed outputs of equal power and phase;

N beam steering phase shifters, each coupled to a corresponding one of said feed outputs, and wherein said N beam steering phase shifters are for shifting the respective feed network outputs by $n\psi$ where n is an integer varying from 1 to N and is a phase shift value;

N main radiating elements equally spaced and adjacent one another to form a linear main element aperture;

N ancillary radiating elements disposed in linear alignment with said main radiating elements;

means for coupling each phase shifted feed output to a main radiating element and a corresponding ancillary radiating element such that the signal power at said feed output is divided between said main radiating element and said corresponding ancillary radiating element, and a uniform phase gradient is invoked between the respective elements of the main element aperture and the respective elements of the ancillary element apertures;

wherein said selected phase shift value is selected to invoke said uniform phase gradient, and corresponds to one of the discrete beam steering phase shifts defined by one of the relationships $(2\pi/N)(m-\bar{n})$, or $(2\pi/N)(n-\bar{n}\frac{1}{2})$ where $\bar{n}=(N+1)/2$ and m is an integer varying from 1 to n; and phase correcting means for correcting the phase of the respective signals applied to said ancillary radiating elements to achieve linear phase continuity between the respective adjacent elements of the main aperture and the ancillary apertures, said means comprising N bi-state phase shifting elements for selectively phase shifting the signals applied to all of said N ancillary elements by either zero or $\pi$ radians to form one of 2N beams.

2. The array of claim 1 further comprising means for controlling the phase shift values of said beam steering phase shifters and said bi-state phase shifters to selectively from one of said 2N beams.

3. The array of claim 1 wherein said coupling means is adapted to provide a tapered aperture illumination distribution.

4. The array of claim 1 wherein said N ancillary radiating elements are disposed such that N/2 radiating elements are disposed in a uniformly spaced relationship adjacent each end of said main element aperture to form first and second ancillary element arrays.

5. The array of claim 1 wherein said N ancillary radiating elements are disposed in a uniformly spaced relationship adjacent one end of said main element aperture to form an ancillary element array.

6. A phased array system employing equal gain active modules to produce a selected tapered aperture distribution without substantial loss and scannable over a wide angle, comprising:

N main radiative elements spatially separated and adjacent one another to form a linear main radiative aperture;

N ancillary radiative elements arranged in a linear relationship with said main radiative aperture;

means for dividing an input signal into N in-phase feed signals of equal power;

means for phase shifting said respective feed signals by a selectable phase shift in response to control signals to steer the array beam in a desired direction within a relatively wide angle;

means for coupling each phase shifted feed signal to a respective main radiative element and a corresponding ancillary radiative element, said means comprising N identical active modules, one associated with a corresponding one of the N phase shifted feed signals, and each module comprises means for amplifying said respective feed signals, the gain of said amplifying means being substantially identical to the gain of the other of said amplifying means of the other of said N modules, each said module further comprising:

means responsive to said feed signal such that the signal power of said amplified feed signal is substantially divided between a main element signal for coupling to said main radiative element and an ancillary element signal for coupling to said corresponding ancillary radiative element;

means responsive to control signal for adjusting the relative power division between said respective main and ancillary element signals to provide a desired array aperture amplitude distribution at said beam direction;

means for correcting the phase of the respective ancillary element signal to achieve linear phase continuity between the respective adjacent elements of the main aperture and the ancillary apertures;

wherein each said active module is further characterized in that no variable phase shift devices are employed in the signal path between the amplifying means and the corresponding radiative elements associated with said active module; and an array controller for providing said control signals to steer the array beam to a desired direction and with a desired array aperture amplitude distribution.

7. The array system of claim 6 wherein each said module comprises:

a first quadrature hybrid coupler device comprising first and second pairs of ports, a first one of said first pair of ports being connected to receive said respective feed signal, so that a first signal component is provided at a first one of said second pair of ports and a second signal component is provided at a second one of said second pair;

first variable phase shift means responsive to said control signals for phase shifting said first signal component by the positive or negative of a selected phase value;

second variable phase shift means for phase shifting said second signal component by the negative or positive of said selected phase value;

first and second amplifier means of substantially identical gain for amplifying said respective phase shifted first and second signal components; and a second quadrature hybrid coupler device comprising first and second pairs of ports, said first and second phase shifted, amplified signal components being received at respective ones of said first pair of ports, said main element signal being taken at a first one of said second pair of ports and said ancillary element signal being taken at a second one of said second pair; and wherein said first and second quadrature hybrid couplers and said first and second phase shift means comprise the means for providing said main element an ancillary element signals and for correcting the phase of the ancillary element signal.

8. The array system of claim 7 wherein each module further comprises means for separating signal components received at the corresponding main and ancillary radiative elements, said means comprising first and second circulator devices disposed in the respective signal paths between said respective ones of the second pair of ports of said second hybrid coupler and the respective main and ancillary elements.

9. The array system of claim 7 wherein each module further comprises means for separating signal components received at the corresponding main and ancillary radiative elements, said means comprising first and second circulator devices disposed in the respective signal path between said respective first and second amplifier means and the respective ones of the first pair of ports of said second hybrid coupler.

10. The array system of claim 6 wherein each of said modules comprises:

means for dividing said respective feed signal into first and second signal components of equal amplitude;

first means for phase shifting said first signal component by the positive or negative of a selected phase value;

second means for phase shifting said second signal component by the negative or positive of said selected phase value;

said first and second means for phase shifting are responsive to said control signal for selecting said phase value and the corresponding positive or negative sign associated therewith;

said amplifying means comprises first and second amplifiers of substantially identical gain for amplifying said respective phase shifted first and second signal components;

means for receiving said amplified first and second phase shifted components and providing said main and ancillary module outputs therefrom, wherein the amplitude of said main output signal is proportional to the cosine of said selected phase value, and the amplitude of said ancillary output is proportional to the positive or negative of the sine of said phase value, the value of said selected phase value being selected to provide the desired array aperture amplitude distribution.

11. The array system of claim 10 wherein said means for receiving said first and second phase shifted components comprises a magic T coupler having first and second sidearm ports, a sum port and a difference port, said first and second phase shifted components coupled respectively to said first and second sidearm ports, said main module signal being taken at said sum port and said ancillary module signal being taken at said difference port.

12. The array system of claim 10 wherein said means for receiving said first and second phase shifted components comprises a 3 dB hybrid coupler, said coupler having one output port coupled to said main module and a second output port coupled to said ancillary module.

13. The array of claim 6 wherein said N ancillary radiating elements are disposed such that N/2 radiating elements are disposed in a uniformly spaced relationship adjacent each end of said main element aperture to form first and second ancillary element arrays.

14. The array of claim 6 wherein said N ancillary radiating elements are disposed in a uniformly spaced relationship adjacent one end of said main element aperture to form an ancillary element array.

15. The array system of claim 6 further comprising N attenuator sets, each set comprising a first attenuator for attenuating a respective main element signal and a second attenuator for attenuating the corresponding ancillary element signal, the respective values of said respective attenuators being selected to reduce the sidelobe levels of the array radiation distribution pattern.

16. A phased array system for producing an electronically scanned receive beam having an adjustable aperture amplitude distribution, comprising:

N main radiative elements spatially separated to form a linear main radiative aperture;

N ancillary radiative elements arranged such that N/2 radiative elements are disposed in a uniformly spaced relationship adjacent each respective end of said main element aperture to form first and second radiative apertures;

2N substantially identical low noise amplifying means for amplifying the signals received at each respective main and ancillary radiative element;

N sum signal circuits responsive to the respective amplified signals at each main radiative element $R_m$ and the amplified signals at corresponding ancillary radiative elements $R_{m+n}$ or $R_{m-n}$ to provide N sum component signals;

wherein each of said N sum signal circuits comprises:

(i) a passive coupler device responsive to said respective amplified main and ancillary receive signals to provide first and second coupler signals of equal amplitude and respective phases $+/-\phi$;

(ii) first and second phase shifters for phase shifting the respective first and second coupler signals by selectable respective phase shifts $-/+\phi$, the value of $\phi$ being selectable to provide a desired array aperture amplitude distribution, and invoking a uniform phase gradient between the adjacent elements of the main element aperture and the respective elements of the ancillary element aperture; and (iii) means for combining said phase shifted first and second coupler signals to form said respective sum component signal;

means for phase shifting said respective sum component signals to steer the array sum beam to a desired direction;

a first uniform corporate feed having N input ports for receiving and combining said N phase shifted sum component signals to provide an array receive sum signal;

N difference signal circuits responsive to the respective amplified signals at each main radiative element $R_m$ and the amplified signals at corresponding ancillary radiative elements $R_{m+n}$ or $R_{m-n}$ to provide N difference component signals;

means for phase shifting said respective N difference component signals to steer the array difference beam to a desired direction; and a second uniform corporate feed network having N input ports for receiving and combining said N difference component signals to provide an array difference signal.

17. A two dimensional phased array, comprising:

first dividing means for dividing an input signal into $N \times L$ feed outputs of equal power and phase;

main phase means for phase shifting each of said feed outputs to steer the array beam in a predetermined direction;

a two dimensional main element aperture comprising a rectilinear N main elements by L main elements matrix of radiating elements;

a two dimensional ancillary element aperture comprising a matrix of ancillary elements, each ancillary element comprising a plurality of radiative elements, said ancillary elements being disposed adjacent said main elements matrix such that two ancillary elements are disposed in a rectilinear relationship with a respective main element;

first, second, and third output terminals; means for coupling said first output terminal to a radiating element of a main element;

means for coupling said second and third output terminals to respective radiating elements in said respective ancillary elements disposed in said rectilinear relationship with said main element;

processing means for processing each said phase shifted feed output to provide first, second, and third output signals and for connecting said first, second, and third output signals to said first, second, and third output terminals respectively, said processing means also for controlling amplitudes so that said second and third output signals have amplitudes different from said first output signal and said processing means also for controlling phases so that said second and third output signals are selectably in phase or out of phase with said first output signal to result in a uniform phase gradient between said main and respective ancillary elements;

wherein said processing means comprises:

second dividing means for dividing said feed output into a plurality of signals;

phase correcting means for applying a phase correction to the plurality of signals to achieve linear phase continuity between the main aperture elements and their respective ancillary elements; and a plurality of substantially identical amplifiers for amplifying said plurality of signals.

18. The array of claim 17 wherein:

(A) said main element array comprises elements at A(n,m), the index n varying from 0 to L, and the index m varying from 0 to N in an orthogonal coordinate system;

(B) the main element array is divided into four quadrants, the boundaries of the first quadrant defined by the element coordinates $n=N/2$ to N and $m=L/2$ to L, the boundaries of the second quadrant defined by the element coordinates $n=0$ to $N/2$ and $m=L/2$ to L, the third quadrant defined by element coordinates $n=0$ to $N/2$ and $m=0$ to $L/2$, and wherein the fourth quadrant is defined by element coordinates $n=N/2$ to N and $m=0$ to $L/2$; and (C) said ancillary matrix comprises eight ancillary arrays each comprising a $N/2$ by $L/2$ radiative elements, said elements being disposed pairwise adjacent the four sides of said main matrix.

19. The array of claim 18 wherein:

(A) the elements in the first quadrant located at respective coordinates A(n,m) are respectively coupled to elements in a first ancillary aperture located at respective coordinates $A(n-N,m)$ and to elements in a second ancillary aperture located at respective coordinates $A(n,m-L)$;

(B) the elements in the second quadrant are respectively coupled to elements in a third ancillary aperture located a respective coordinates $A(n+N,m)$ and to elements in a second ancillary aperture located at respective coordinates A(n,m-L);

(C) the elements in the third quadrant are respectively coupled to elements in a fifth ancillary aperture located at respective coordinates $A(n+N,m)$ and to elements in a sixth ancillary aperture located at respective coordinates $A(n,m+L)$;

(D) the elements in the fourth quadrant are respectively coupled to elements in seventh ancillary aperture located at respective coordinates A(n-N,m) and to elements in an eighth ancillary quadrant located at respective coordinate $A(n,m+L)$.

20. The array of claim 19 wherein the means for coupling each phase shifted feed output to a main radiating element and to two corresponding ancillary radiating elements adjusts the power split among the main and ancillary elements to achieve a desired array aperture amplitude distribution.

21. A two dimensional phased array, comprising: first dividing means for dividing an input signal into N×L feed outputs of equal power and phase;

main phase means for phase shifting each of said feed outputs to steer the array beam in a predetermined direction;

a two dimensional main element aperture comprising a rectilinear N main elements by L main elements matrix of radiating elements;

a two dimensional ancillary element aperture comprising a matrix of ancillary elements, each ancillary element comprising a plurality of radiative elements, said ancillary elements being disposed adjacent said main elements matrix such that three ancillary elements are disposed in a rectilinear relationship with a respective main element;

first, second, third, and fourth output terminals;

means for coupling said first output terminal to a radiating element of a main element;

means for coupling said second, third, and fourth output terminals to respective radiating elements in said respective ancillary elements disposed in said rectilinear relationship with said main element;

processing means for processing each said phase shifted feed output to provide first, second, third, and fourth output signals and for connecting said first, second, third, and fourth output signals to said first, second, third, and fourth output terminals respectively, said processing means also for controlling the amplitudes of said second, third, and fourth output signals to achieve a predetermined array amplitude distribution and said processing means also for controlling phases so that said second, third, and fourth output signals are selectably in phase or out of phase with said first output signal to result in a uniform phase gradient between said main and respective ancillary elements; wherein said processing means comprises:

second dividing means for dividing said feed output into a plurality of signals;

phase correcting means for applying a phase correction to the plurality of signals to achieve linear phase continuity between the main aperture elements and their respective ancillary elements; and a plurality of substantially identical amplifiers for amplifying said plurality of signals.

22. An active module for use in a phased array system, said module responsive to a feed signal for controlling the phase and amplitude of signals fed to a plurality of radiative elements of the phased array associated with said module, comprising:

means for dividing the feed signal into at least first and second components of equal amplitude;

first and second variable phase shift means responsive to control signals for selectively phase shifting said first and second signal components by selectable first and second phase shifts;

first and second amplifier means of substantially equal gain for amplifying said phase shifted first and second signal components;

means having first and second pairs of ports and responsive to said phase shifted, amplified first and second signal components connected at respective ones of said first pair of ports for providing at least first and second radiative element signals at said second pair of ports to be fed to said corresponding radiative elements; and wherein said module is further characterized in that no variable phase shift devices are disposed in the signal paths between said amplifier means and said second pair of ports of said means for providing said first and second radiative element signals.

whereby the amplitude and phase of said first and second radiative element siganls may be controlled by said control signals.

23. The module of claim 22 wherein said means for providing said at least first and second radiative element signals comprises a magic T coupler device having first and second sidearm ports, a sum port and a difference port, and a fixed 90 degree phase device coupled to said difference port, said first and second phase shifted, samplified component signals coupled respectively to said first and second sidearm ports, said first radiative element signal being taken at said sum port and said second radiative element signal being taken at said fixed phase shifter output.

24. The module of claim 22 wherein said means for dividing said feed signal into at least first and second signal components comprises a first quadrature hybrid coupler device having first and second pairs of ports, said feed signal being connected to one of said first pair of ports, the first and second signal components being taken at respective ones of said second pair of ports, and wherein said means for providing said first and second radiative element signals comprises a second quadrature hybrid coupler device having first and second pairs of ports, said first and second phase shifted, amplified signal components being coupled to respective ones of said first pair of ports, and said first and second radiative element signals are taken at respective ones of said second pair of ports.

25. The module of claim 24 further comprising means for separating receive signals received at said respective radiative elements, said means comprising first and second circulator devices disposed in the signal path between said respective second pair of ports of said second hybrid coupler and said respective radiative elements.

26. The module of claim 24 further comprising means for separating receive signals received at said respective radiative elements, said means comprising first and second circulator devices disposed in the signal paths between said respective first and second amplifier means and the corresponding ones of the first pair of ports of said second hybrid coupler.

27. The module of claim 22 wherein said first phase shift is the positive or negative of a selected phase value, and said second phase shift is the negative or positive of said selected phase value.

* * * * *